US007866248B2

(12) United States Patent
Moore, III et al.

(10) Patent No.: US 7,866,248 B2
(45) Date of Patent: Jan. 11, 2011

(54) ENCAPSULATED CERAMIC COMPOSITE ARMOR

(75) Inventors: Dan T. Moore, III, Cleveland Heights, OH (US); Ajit Sane, Medina, OH (US); Jeff Lennartz, Cleveland, OH (US); Bruce O. Budinger, Chagrin Falls, OH (US); James L. Eucker, North Ridgeville, OH (US); Charles M. Milliren, Chesterland, OH (US)

(73) Assignee: Intellectual Property Holdings, LLC, Cleveland, OH (US)

( * ) Notice: Subject to any disclaimer, the term of this patent is extended or adjusted under 35 U.S.C. 154(b) by 552 days.

(21) Appl. No.: 11/656,603

(22) Filed: Jan. 23, 2007

(65) Prior Publication Data

US 2009/0114083 A1 May 7, 2009

Related U.S. Application Data

(60) Provisional application No. 60/761,270, filed on Jan. 23, 2006, provisional application No. 60/761,268, filed on Jan. 23, 2006, provisional application No. 60/761,269, filed on Jan. 23, 2006, provisional application No. 60/849,940, filed on Oct. 6, 2006.

(51) Int. Cl.
*F41H 5/04* (2006.01)

(52) U.S. Cl. ..... 89/36.02

(58) Field of Classification Search ..... 89/36.02
See application file for complete search history.

(56) References Cited

U.S. PATENT DOCUMENTS 3,444,033 A * 5/1969 King ..... 428/49
3,563,836 A * 2/1971 Dunbar ..... 428/44
3,617,230 A 11/1971 Richards
3,684,631 A * 8/1972 Dunbar ..... 428/46
3,765,299 A 10/1973 Pagano et al.
3,804,017 A 4/1974 Venable et al.
3,815,312 A 6/1974 Lench
3,826,172 A 7/1974 Dawson
3,834,948 A 9/1974 Brickner et al.
3,916,060 A * 10/1975 Fish et al. ..... 428/299.4
4,111,097 A 9/1978 Lasker
4,125,053 A 11/1978 Lasker
4,179,979 A 12/1979 Cook et al.
4,316,404 A 2/1982 Medlin
4,320,204 A 3/1982 Weaver
4,352,316 A 10/1982 Medlin
4,368,660 A 1/1983 Held
4,404,889 A 9/1983 Miguel
4,446,190 A 5/1984 Pernici (Continued)

FOREIGN PATENT DOCUMENTS

EP 287918 A1 10/1988

(Continued)

OTHER PUBLICATIONS

M.L. Wilkins, "Use of Boron Compounds in Lightweight Armor," Boron and Refractory Borides, edited by V.I. Matkovich (1977), pp. 633-648.

(Continued)

*Primary Examiner*—Stephen M Johnson
(74) *Attorney, Agent, or Firm*—Pearne & Gordon LLP

(57) ABSTRACT

A composite armor including a disrupting layer and a backing layer provides protection against blast and ballistic threats. The disrupting layer includes ceramic particles or tiles that disrupt the incoming projectile, while the backing layer prevents penetration past the armor by the disrupted projectile. The disrupting layer may include a layer of polygonal ceramic tiles with a deflecting front surface, encased by a retaining polymer, and may also include fire-retarding particles.

21 Claims, 4 Drawing Sheets

U.S. PATENT DOCUMENTS

| | | | | |
|---|---|---|---|---|
| 4,517,321 | A | 5/1985 | Gardner et al. | |
| 4,633,756 | A * | 1/1987 | Rudoi | 89/36.02 |
| 4,709,453 | A | 12/1987 | Harvey et al. | |
| 4,739,690 | A | 4/1988 | Moskowitz | |
| 4,757,742 | A | 7/1988 | Mazelsky | |
| 4,760,611 | A | 8/1988 | Huet et al. | |
| 4,820,545 | A | 4/1989 | Negrych | |
| 4,824,624 | A | 4/1989 | Palicka et al. | |
| 4,867,077 | A | 9/1989 | Marlow et al. | |
| 4,868,040 | A | 9/1989 | Hallal et al. | |
| 4,879,165 | A | 11/1989 | Smith | |
| 4,881,448 | A | 11/1989 | Medin et al. | |
| 4,925,338 | A | 5/1990 | Kapusta | |
| 4,928,575 | A | 5/1990 | Smirlock et al. | |
| 4,953,442 | A | 9/1990 | Bartuski | |
| 5,007,326 | A | 4/1991 | Gooch, Jr. et al. | |
| 5,012,721 | A | 5/1991 | Medin et al. | |
| 5,014,593 | A | 5/1991 | Auyer et al. | |
| 5,014,760 | A | 5/1991 | Bombeke et al. | |
| 5,083,515 | A | 1/1992 | Seksaria et al. | |
| 5,114,772 | A | 5/1992 | Vives et al. | |
| 5,131,314 | A | 7/1992 | Hansen et al. | |
| 5,149,910 | A * | 9/1992 | McKee | 89/36.02 |
| 5,170,690 | A | 12/1992 | Smirlock et al. | |
| 5,191,166 | A | 3/1993 | Smirlock et al. | |
| 5,206,451 | A | 4/1993 | Bocker | |
| 5,326,606 | A | 7/1994 | Labock | |
| 5,333,532 | A | 8/1994 | Smirlock et al. | |
| 5,340,107 | A | 8/1994 | Baker et al. | |
| 5,349,893 | A | 9/1994 | Dunn | |
| 5,361,678 | A | 11/1994 | Roopchand et al. | |
| 5,370,034 | A | 12/1994 | Turner et al. | |
| 5,421,087 | A | 6/1995 | Newkirk et al. | |
| 5,438,089 | A | 8/1995 | Hoppener | |
| 5,458,699 | A | 10/1995 | Tsukamoto et al. | |
| 5,480,706 | A | 1/1996 | Li et al. | |
| 5,553,455 | A | 9/1996 | Craig et al. | |
| 5,569,528 | A | 10/1996 | Van der Loo et al. | |
| 5,577,432 | A | 11/1996 | Becker et al. | |
| 5,609,804 | A | 3/1997 | Alieri | |
| 5,639,531 | A | 6/1997 | Chen et al. | |
| 5,645,184 | A | 7/1997 | Rowse et al. | |
| 5,686,689 | A * | 11/1997 | Snedeker et al. | 89/36.02 |
| 5,705,764 | A | 1/1998 | Schade et al. | |
| 5,720,910 | A | 2/1998 | Vlajic et al. | |
| 5,720,911 | A | 2/1998 | Taylor et al. | |
| 5,738,925 | A | 4/1998 | Chaput | |
| 5,750,272 | A | 5/1998 | Jardine | |
| 5,763,813 | A | 6/1998 | Cohen et al. | |
| 5,792,974 | A | 8/1998 | Daqis et al. | |
| 5,830,548 | A | 11/1998 | Andersen et al. | |
| 5,830,551 | A | 11/1998 | Kakamu et al. | |
| 5,972,819 | A | 10/1999 | Cohen | |
| 5,996,115 | A | 12/1999 | Mazelsky | |
| 6,017,987 | A * | 1/2000 | Okisaki et al. | 524/408 |
| 6,035,438 | A | 3/2000 | Neal et al. | |
| 6,112,635 | A | 9/2000 | Cohen | |
| 6,170,378 | B1 | 1/2001 | Neal et al. | |
| 6,289,781 | B1 | 9/2001 | Cohen | |
| 6,298,607 | B1 | 10/2001 | Mostaghel et al. | |
| 6,311,605 | B1 | 11/2001 | Kellner et al. | |
| 6,341,708 | B1 | 1/2002 | Palley et al. | |
| 6,345,563 | B1 | 2/2002 | Middione et al. | |
| 6,357,332 | B1 | 3/2002 | Vecchio | |
| 6,405,626 | B1 | 6/2002 | Bureaux et al. | |
| 6,408,734 | B1 | 6/2002 | Cohen | |
| 6,474,213 | B1 | 11/2002 | Walker et al. | |
| 6,497,966 | B2 | 12/2002 | Cohen | |
| 6,532,857 | B1 | 3/2003 | Shih et al. | |
| 6,553,887 | B1 | 4/2003 | Bureaux et al. | |
| 6,575,075 | B2 | 6/2003 | Cohen | |
| 6,609,452 | B1 | 8/2003 | McCormick et al. | |
| 6,612,217 | B1 | 9/2003 | Shockey et al. | |
| 6,624,106 | B2 | 9/2003 | Cohen | |
| 6,689,462 | B2 | 2/2004 | Ohta et al. | |
| 6,709,736 | B2 | 3/2004 | Gruber et al. | |
| 6,723,267 | B2 | 4/2004 | Simmelink et al. | |
| 6,745,661 | B1 | 6/2004 | Neal et al. | |
| 6,777,081 | B2 * | 8/2004 | Boesman et al. | 428/361 |
| 6,782,790 | B2 | 8/2004 | Barrett | |
| 6,782,793 | B1 | 8/2004 | Lloyd | |
| 6,793,291 | B1 | 9/2004 | Kocher | |
| 6,805,034 | B1 | 10/2004 | McCormick et al. | |
| 6,807,891 | B2 * | 10/2004 | Fisher | 89/36.02 |
| 6,826,996 | B2 | 12/2004 | Strait | |
| 6,845,701 | B2 | 1/2005 | Drackett | |
| 6,860,186 | B2 | 3/2005 | Cohen | |
| 6,862,970 | B2 | 3/2005 | Aghajanian et al. | |
| 6,883,724 | B2 | 4/2005 | Adiga et al. | |
| 6,892,623 | B2 | 5/2005 | Benyami et al. | |
| 6,893,704 | B1 | 5/2005 | van der Loo | |
| 6,912,944 | B2 | 7/2005 | Lucuta et al. | |
| 6,916,533 | B2 | 7/2005 | Simmelink et al. | |
| 6,923,107 | B2 | 8/2005 | Zurek et al. | |
| 6,951,162 | B1 | 10/2005 | Shockey et al. | |
| 6,955,112 | B1 | 10/2005 | Adams et al. | |
| 6,964,809 | B2 | 11/2005 | Hojaji et al. | |
| 7,037,865 | B1 | 5/2006 | Kimberly | |
| 7,114,764 | B1 | 10/2006 | Barsoum et al. | |
| 7,117,780 | B2 | 10/2006 | Cohen | |
| 2002/0010071 | A1 | 1/2002 | Cohen | |
| 2002/0094406 | A1 | 7/2002 | Cohen | |
| 2002/0178900 | A1 | 12/2002 | Ghiorse et al. | |
| 2003/0064191 | A1 | 4/2003 | Fisher | |
| 2003/0150321 | A1 | 8/2003 | Lacuta et al. | |
| 2003/0151152 | A1 | 8/2003 | Nichelson et al. | |
| 2003/0159575 | A1 | 8/2003 | Reichman | |
| 2003/0167910 | A1 | 9/2003 | Strait | |
| 2003/0221547 | A1 | 12/2003 | Peretz | |
| 2004/0020354 | A1 | 2/2004 | Ravid et al. | |
| 2004/0065868 | A1 | 4/2004 | Aghajanian et al. | |
| 2004/0082242 | A1 | 4/2004 | Bottger et al. | |
| 2004/0083525 | A1 | 5/2004 | Wells, Jr. | |
| 2004/0083879 | A1 | 5/2004 | Benyami et al. | |
| 2004/0083880 | A1 | 5/2004 | Cohen | |
| 2004/0092183 | A1 | 5/2004 | Geva et al. | |
| 2004/0118271 | A1 | 6/2004 | Puckett et al. | |
| 2004/0144244 | A1 | 7/2004 | Sargent | |
| 2004/0154464 | A1 | 8/2004 | Zurek et al. | |
| 2004/0159228 | A1 | 8/2004 | Budnik | |
| 2004/0161605 | A1 | 8/2004 | Simmelink et al. | |
| 2004/0216595 | A1 | 11/2004 | Dickson | |
| 2004/0221712 | A1 | 11/2004 | Stewart et al. | |
| 2004/0237713 | A1 | 12/2004 | Breslin et al. | |
| 2004/0237763 | A1 | 12/2004 | Bhatnagar et al. | |
| 2004/0255768 | A1 | 12/2004 | Rettenbacher et al. | |
| 2004/0255769 | A1 | 12/2004 | Drackett | |
| 2005/0046235 | A1 | 3/2005 | Robertson et al. | |
| 2005/0053769 | A1 | 3/2005 | Imblum et al. | |
| 2005/0066805 | A1 | 3/2005 | Park et al. | |
| 2005/0072294 | A1 | 4/2005 | Cohen | |
| 2005/0087064 | A1 | 4/2005 | Cohen | |
| 2005/0119104 | A1 | 6/2005 | Alexander et al. | |
| 2005/0172792 | A1 | 8/2005 | Wolf et al. | |
| 2005/0188825 | A1 | 9/2005 | Sharpe et al. | |
| 2005/0188831 | A1 | 9/2005 | Squires et al. | |
| 2005/0193667 | A1 | 9/2005 | Henry et al. | |
| 2005/0235818 | A1 | 10/2005 | Lucuta et al. | |
| 2005/0242093 | A1 | 11/2005 | Sharpe et al. | |
| 2005/0257677 | A1 | 11/2005 | Ravid et al. | |
| 2006/0011057 | A1 | 1/2006 | Yael et al. | |
| 2006/0013977 | A1 | 1/2006 | Duke et al. | |
| 2006/0048640 | A1 | 3/2006 | Terry et al. | |
| 2006/0060077 | A1 | 3/2006 | Lucuta et al. | |

| | | | | |
|---|---|---|---|---|
| 2006/0065111 | A1 | 3/2006 | Henry | |
| 2006/0105156 | A1 | 5/2006 | Simmonsen et al. | |
| 2006/0105653 | A1 * | 5/2006 | Porter | 442/79 |
| 2006/0141232 | A1 | 6/2006 | Ma | |
| 2006/0145009 | A1 | 7/2006 | Shockey et al. | |
| 2006/0191403 | A1 | 8/2006 | Hawkins et al. | |
| 2006/0201318 | A1 | 9/2006 | LaBrash et al. | |
| 2006/0213360 | A1 | 9/2006 | Ravid et al. | |
| 2006/0243127 | A1 | 11/2006 | Cohen | |
| 2006/0252328 | A1 | 11/2006 | Bingenheimer | |
| 2006/0254413 | A1 | 11/2006 | Yael et al. | |
| 2007/0028757 | A1 * | 2/2007 | Cohen | 89/36.02 |
| 2008/0264243 | A1 | 10/2008 | Lucuta et al. | |
| 2008/0282876 | A1 | 11/2008 | Leivesley et al. | |

FOREIGN PATENT DOCUMENTS

| | | | | |
|---|---|---|---|---|
| EP | 299253 | A1 | 1/1989 | |
| EP | 307672 | A1 | 3/1989 | |
| EP | 301663 | B1 | 3/1992 | |
| EP | 340877 | B1 | 8/1992 | |
| EP | 504786 | A2 | 9/1992 | |
| EP | 629594 | A1 | 6/1993 | |
| EP | 678724 | A1 | 10/1995 | |
| EP | 629594 | B1 | 2/1996 | |
| EP | 568615 | B1 | 9/1997 | |
| EP | 843149 | A1 | 5/1998 | |
| EP | 782554 | B1 | 9/1998 | |
| EP | 891957 | A1 | 1/1999 | |
| EP | 942255 | A1 | 9/1999 | |
| EP | 689501 | B1 | 9/2000 | |
| EP | 954658 | B1 | 4/2002 | |
| EP | 1193335 | A1 | 4/2002 | |
| EP | 833742 | B1 | 9/2002 | |
| EP | 1298407 | A1 | 4/2003 | |
| EP | 1308255 | A1 | 5/2003 | |
| EP | 1512714 | A1 | 3/2005 | |
| GB | 2 149 482 | A * | 6/1985 | 89/36.02 |
| WO | 2004099705 | A1 | 11/2004 | |
| WO | 2006002898 | A1 | 1/2006 | |
| WO | 2006083391 | A2 | 8/2006 | |
| WO | 2006085982 | A2 | 8/2006 | |
| WO | 2006087699 | A2 | 8/2006 | |

OTHER PUBLICATIONS

"Chobham Armour," http://en.wikipedia.org/wiki/Chobham_armour.
"LAST Armor: Lightweight Add-On Armor for LAVs and Other Tactical Ground Vehicles," brochure from Foster-Miller.
"LAST Armor: Lightweight Add-On Armor for Aircraft," brochure from Foster-Miller.
"LAST Armor: Lightweight Spall Liners for Vehicles," brochure from Foster-Miller.
"Cost Effective, Advanced Ceramic Armor," promotional materials from Foster-Miller dated Sep. 4, 1992.
"Project Examples: LAST Armor," page from Foster-Miller website.
"Advanced Armor Technology," brochure from Ceradyne, Inc.
"Ceradyne Vehicle Armor Systems—Lightweight Ceramic Vehicle Armor for Multi-Hit Ballistic Protection and Survivability," page from www.army-technology.com website.
"Best Practice: Sand Bag Protection Position," undated document.
X. Huang et al., "Properties and Potential for Application of Steel Reinforced Polymer (SRP) and Steel Reinforced Grout (SRG) Composites," paper published on www.hardwirellc.com.
"Hardwire Coupon Testing at the U.S. Navy Lab," document posted on www.hardwirellc.com.
"Armor Materials," brochure from M Cubed Technologies, Inc., Newark, DE, dated Jun. 19, 2003.
"Reaction Bonded Boron Carbide for Ballistic Applications," brochure from M Cubed Technologies, Inc., Newark, DE, dated Feb. 21, 2003.
"Reaction Bonded Silicon Carbide for Ballistic Applications," brochure from M Cubed Technologies, Inc., Newark, DE, dated Feb. 21, 2003.
"Reaction Bonded Silicon Carbide Ceramics," technical note from M Cubed Technologies, Inc., Monroe, CT, dated Nov. 18, 1999.
"Si Wafer Chucks," technical note from M Cubed Technologies, Inc. (not dated).
"Nominal Properties of Standard Materials Offered by M Cubed Technologies," data sheet from M Cubed Technologies, Inc., Monroe, CT, dated Dec. 14, 2003.
Christine L. Grahl, "Saving Lives with Ceramic Armor," article published on www.ceramicindustry.com, Jun. 1, 2003.
Jonathan D. Epstein, "Armor Protects Newark Firm," The News Journal, New Castle, DE, Apr. 14, 2002.
"Ceramic Materials for Composite Armor Protection Systems," brochure from Saint-Gobain Ceramics, Niagara Falls, NY, dated May 2004.
"Modular Armored Sentry Shield (MASS) from Special Tactical Services, LLC (STS)," posted on www.defensereview.com.
"SOV™ Flexible Body Armor," web page from www.pinnaclearmor.com.
"ECO-BLOK™ BARRIER-BLOK™ and FILTER-BLOK™," web page from www.eco-blok.com.
"California Company Uses Recycled Tires to Protect Troops," news release from Eco-Blok, LLC, Newbury Park, CA, dated Jul. 20, 2004.
David Brinn, "US Marine Corps to Use Lightweight Israeli Armor for Military Vehicles," article published on www.israel21c.com, Oct. 9, 2005.
"Carbides," from Breviary Technical Ceramics, posted on http://keramverband.de/brevier_engl/brevier.htm.
"Appendix: Other Materials," from Breviary Technical Ceramics, posted on http://keramverband.de/brevier_engl/brevier.htm.
Web page from www.ksci.com, Kansas Structural Composites, Inc., Russell, KS.
"Non-mobility Applications," brochure from Composhield A/S, Hobro Denmark (not dated).
"Fast Ballistic Protection for Mobile Troops," web page from www.tekes.fi, dated Aug. 7, 2005.
"Ballistic Protective Blankets," discussion posted on www.g2mil.com.
"Improved Body Armor: Wave Armor," brochure from Dynamic Defense Materials, Boothwyn, PA (not dated).
"August Two-Minute Forum: DefBar Systems, LLC," from Enterprise newsletter published by Missouri Venture Forum, Sep. 2006.
"Enhanced Manufacturing Processes for Body Armor Materials," U.S. Department of Defense Manufacturing Technology Program (not dated).
"Personal Protection, Medical and Survival Equipment Gallery," web page from www.army-technology.com.
"Light improved Ballistic Armor (LIBA)", http://www.defense-updated.com/products/l/liba.htm, dated Apr. 24, 2007.
Laurel M. Sheppard, "About: Composites/Plastics", http://composite.about.com/library/weekly/aa030529.h5m, dated Apr. 24, 2007.
International Search Report and Written Opinion issued in the corresponding PCT application PCT/US07/79907.

* cited by examiner

FIG. 4
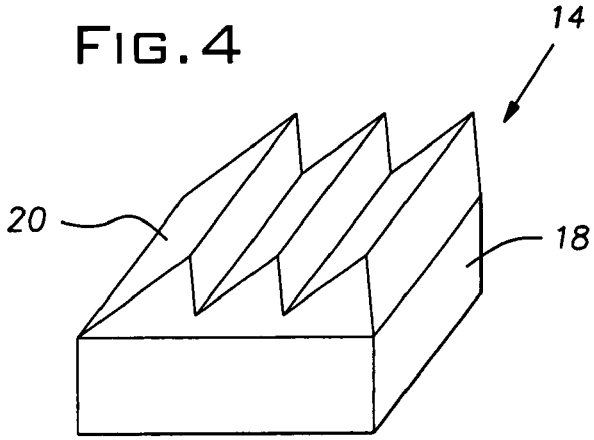
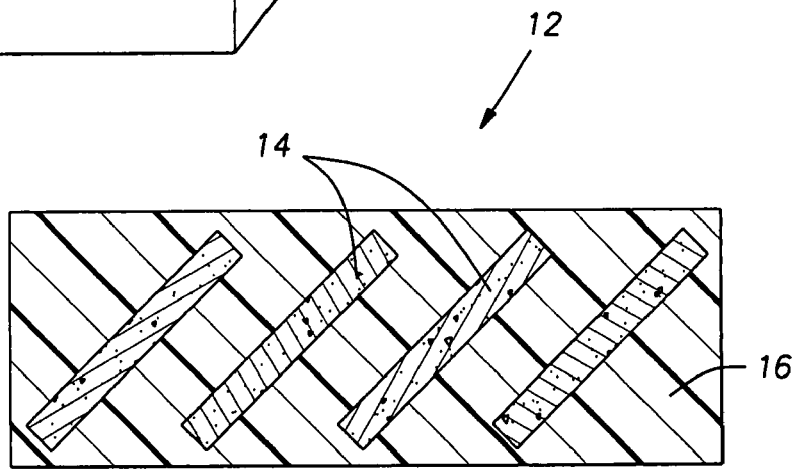
FIG. 5
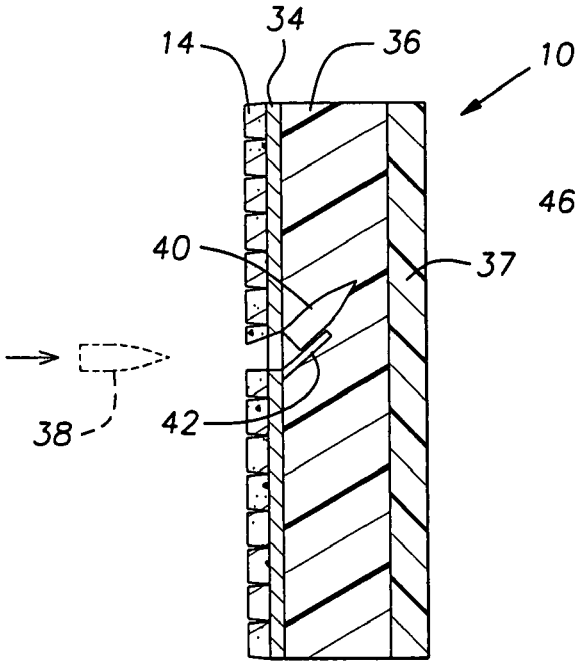
FIG. 6
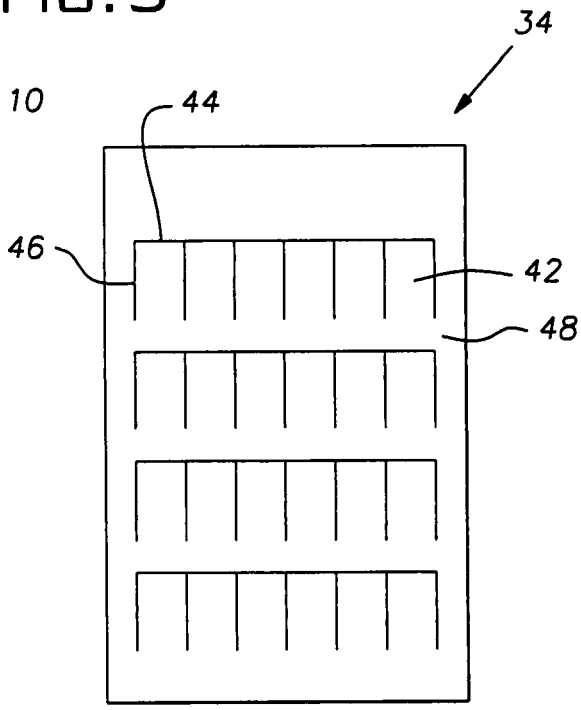
FIG. 7

ENCAPSULATED CERAMIC COMPOSITE ARMOR

CONTINUING APPLICATION DATA

This application claims the benefit of U.S. Provisional Application No. 60/761,270, filed Jan. 23, 2006, U.S. Provisional Application No. 60/761,268, filed Jan. 23, 2006, U.S. Provisional Application No. 60/761,269, filed Jan. 23, 2006, and U.S. Provisional Application No. 60/849,940, filed Oct. 6, 2006, which are incorporated by reference herein.

FIELD OF THE INVENTION

The invention relates to composite armor. More specifically, the invention relates to composite armor including encapsulated ceramic material that may be used to protect vehicles from ballistic and overpressure threats.

BACKGROUND OF THE INVENTION

Increased levels of unconventional or asymmetric warfare have led to the need to protect vehicles and/or personnel from munitions typically used in this type of warfare, such as small arms fire and improvised explosive devices (IEDs). While a variety of means are available to minimize casualties from these threats, such as increased training and "render safe" procedures, the use of armor shielding remains an important last line of defense. As a result of the need to protect a large number of potential targets while not hindering their mobility, it is also important to be able to provide armor shielding that is lightweight and relatively inexpensive.

One method of providing armor that is lighter and stronger is to use composite armor. Composite armor consists of different materials such as metals, plastics, or ceramics that together provides an armor that is stronger and lighter than traditional pure metal armor. A relatively famous form of composite armor is so called "Chobham armor," that sandwiches a layer of ceramic between two plates of steel armor, and is used on main battle tanks such as the Abrams, where it has been proven to be highly effective in defeating high explosive anti-tank (HEAT) rounds. However, while "Chobham armor" is well suited for use placement on a main battle tank, it is too heavy and expensive for use on lighter fighting vehicles or transports.

Composite materials have also been prepared for use as lightweight armor for lighter fighting vehicles. A relatively common vehicle that has been protected using lightweight composite material is the M1114 High Mobility Multi-Purpose Wheeled Vehicles (HMMWV). The composite used to armor the HMMWWV is called HJ1. This material includes high-strength S-2 Glass™ fibers (Owens Corning) and phenolic resin that complies with MIL-L-64154 requirements, and is laminated into hard armor panels that offer significant protection against fragmented ballistic threats when compared to monolithic systems on an equivalent weight basis. However, relatively simple fiber-based composite armors have difficulty protecting vehicle occupants against many common ballistic and blast threats.

Armor piercing (AP) ammunition is designed to penetrate the hardened armor of modern military vehicles. It typically includes a sharp, hardened steel or tungsten carbide penetrator covered with a guilding metal jacket that adds mass and allows the projectile to conform to a rifled barrel and spin for accuracy. When an AP round hits armor, the guilding is rapidly deformed and drops away, leaving the sharpened penetrator traveling with a high velocity to bore its way through the armor. Studies indicate that sharp-nosed projectiles tend to move the fibers within the composite laterally away from the advancing projectile, resulting in kinked fibers around the penetration cavities but with little energy absorption. Thus, the primary reason why armor-piercing projectiles are so effective against fiber-based composite armor is that neither the fiber nor matrix material of the composite is hard enough to cause deformation of the sharp, hardened penetrator nose.

Ceramic faced armor systems were thus developed to defeat AP ammunition by breaking up the projectile in the ceramic material and terminating the fragment energy in the backing plate that supports the ceramic tiles. During impact, the projectile is blunted and cracked or shattered by the hard ceramic face. Fragmentation and comminution are produced in the ceramic and the projectile, resulting in fine ceramic rubble traveling with the projectile. The incident momentum of the initial projectile is thus transferred to fragments of shattered projectile and the ceramic rubble. The ceramic rubble typically has a mass comparable to the initial projectile; hence, the final shattered projectile and ceramic rubble exhibit a much lower impact velocity on the backing plate.

Unfortunately, during this process, the armor system is typically damaged. In order for such systems to defeat additional impacts of the threat that are near to previous impacts, the size of the damaged area produced in the armor system needs to be controlled and minimized. With better damage control, the damage size produced is smaller and more closely spaced hits can be defeated by the armor. Armor systems containing segmented ceramics in the form of "tiles" solve a part of this problem because cracks cannot propagate from one tile to another. However, strong stress waves can still damage tiles adjacent to the impacted tile by propagating through the edges of the impacted tile and into adjacent tiles. Ceramic tiles can also be damaged by the deflection and vibration of the backing plate. In addition, impact from the lateral displacement of material during ceramic fracturing can crush and damage adjacent tiles. These armor damage mechanisms must be suppressed in order to provide armor with the ability to reliably defeat multiple projectile impacts.

Additional examples of attempts to provide composite armor suitable for deployment on personnel and lighter fighting vehicles are provided by U.S. Pat. No. 6,575,075 (issued to Cohen) and U.S. Pat. No. 6,912,944 (issued to Lucuta et al). These patents provide a ceramic along with a polymer to constrain the fractured ceramic in a localized area. Cohen describes a composite armor plate that includes a layer of pellets held together as a plate by a "solidifying material" (e.g., an epoxy or thermoplastic polymer) such that the pellets form a plurality of adjacent rows. The pellets are formed from glass or ceramic, and include a channel on the inward-facing side of the pellet in order to reduce its weight. Lucuta et al. describes a ceramic armor system that includes a ceramic plate formed from a plurality of interconnecting ceramic tiles. The ceramic tiles have a flat ceramic base upon which are disposed a plurality of smaller nodes, which are asserted to provide a greater degree of protection and contribute to the scattering of radar signals. In particular, nodes are formed from partial nodes at the edges of the ceramic tiles to protect the joining sites between tiles. The ceramic armor system further includes a spall layer bonded to the front surface of the ceramic plate, a shock-absorbing layer bonded to the rear surface of the ceramic plate, and a backing bonded to the rear surface of the shock-absorbing layer. The nodes however, do not cover the entire surface, i.e., a portion of the surface is flat and hence not oriented (to the direction of perceived threat) for deflection.

However, these examples do not provide guidance on how to provide composite armor that achieves an areal density well below the areal density of rolled homogeneous armor or similar steel armor solutions needed to defeat a ballistic threat. Areal density measures the ability of an armor to provide protection for a given weight, and is measured in pounds per square foot. For example, in Lucuta et al., the thickness of the ceramic tile will always be above the critical limit needed to defeat a projectile, resulting in the presence of excess material that will result in increased areal density. These forms of armor have not ensured that the tile thickness and therefore the areal density is not excessive without sacrificing ballistic performance.

There thus remains a need for composite armor that is more lightweight, inexpensive, compact, durable, or protective, or exhibits a combination of improvements in these areas.

SUMMARY OF THE INVENTION

The present invention thus provides, in one aspect, a composite armor that includes a disruptive layer including a sheet of adjoining polygonal ceramic tiles encased by a retaining polymer, the ceramic tiles having a non-spherical deflecting front surface, and a backing layer adjacent to the disruptive layer. The backing layer may be formed of a polymer encased reinforcement including steel wires, metal bonded steel wires, ceramic or glass fibers, or a metallic sheet. The composite armor may also include a spalling layer adjacent to the disruptive layer, wherein the spalling layer includes a polymer-encased reinforcement. Embodiments of the composite armor provide a disruptive layer than has an areal density less than 50% of the areal density of rolled homogeneous armor given by the density of rolled homogeneous armor and the depth of penetration by a specific ballistic projectile.

In a further embodiment of the composite armor, the retaining polymer includes a polyurethane polymer. The retaining polymer may also include fire-retarding particles. Embodiments including fire-retarding particles may, in some cases, have particles with a diameter of about 0.1 mm to about 3 mm. In further embodiments, the fire-retarding particles include a material selected from the group consisting of perlite, vermiculite, zinc borate, alumina hydrate, aluminum phosphate, aluminum borates and mixtures thereof.

In additional embodiments, the composite armor includes ceramic tiles that have a thickness of about 10 to about 30 mm and a width of about 30 to 60 mm and density greater than 90% of theoretical density. The ceramic tiles may include one or more ceramics selected from the group consisting of aluminum oxide, magnesium oxide, silicon carbide, silicon nitride, silicon oxide, boron carbide, borides, carbides or nitrides of aluminum, silicon, or refractory metals.

In a further embodiment, the composite armor includes ceramic tiles in which a portion of the deflecting front surface of the ceramic tiles is substantially conical or pyramidal. In additional embodiments, the deflecting front surface of the ceramic tiles flares upwards forming a thicker rim along outer edges of the polygonal base. The deflecting front surface of the ceramic tiles may include an angle of inclination of about 20 to about 30 degrees. In some embodiments, the deflecting front surface of the ceramic tiles is wedge-shaped. In additional embodiments, the deflecting front surface includes a trough region between the thicker rim and a central conical or pyramidal portion, wherein the trough region includes alternating ridges. In further embodiments, the adjoining polygonal ceramic tiles include a base portion opposite from the deflecting front surface wherein the base portion includes a cavity. In additional embodiments, the cavity may include a fire retarding material.

In yet further embodiments of the composite armor, an adhesive layer is provided between the backing layer and the disruptive layer. Embodiments of the composite armor may provide an areal density of about 25 pounds per square foot or less.

In a further aspect, the composite armor of the invention includes a disruptive layer including a sheet of adjoining polygonal ceramic tiles encased by a retaining polymer including fire-retarding particles, the ceramic tiles having a substantially conical or pyramidal deflecting front surface; and a backing layer bonded to the disruptive layer comprising a sheet of metal or polymer-encased reinforcement, wherein the composite armor has an areal density of less than 50% of the areal density of rolled homogeneous armor needed to defeat a given ballistic threat.

In another aspect, the renewable composite armor includes a disruptive layer including a packed bed of flowable granules and a backing layer bonded to the disruptive layer that includes a sheet of metal or polymer-encased reinforcement. Embodiments of the renewable composite armor may further provide for retaining the packed bed of flowable granules between two confining layers. Embodiments may also include an adhesive layer between the backing layer and the disruptive layer.

Embodiments of the renewable composite armor may also provide flowable granules that include a material selected from the group consisting of tabular alumina, silicon carbide grains, fused alumina grains, sintered boron carbide grains, sintered alumina, silicon carbide, boron carbide, titanium diboride-aluminum composite, and ceramics such as oxides, carbides, nitrides, or borides of aluminum, magnesium, silicon, or mixtures thereof. In additional embodiments, the disruptive layer includes a sheet of adjoining polygonal ceramic tiles encased by a retaining polymer. In yet additional embodiments, the retaining polymer includes fire-retarding particles.

BRIEF DESCRIPTION OF THE FIGURES

The following figures illustrate various aspects of one or more embodiments of the present invention, but are not intended to limit the present invention to the embodiments shown.

FIG. 3*a* provides a cross-sectional view of a tile, revealing a hollow cavity at the center of the base that reduce the thickness of the tile in the center, while FIG. 3*b* provides a top perspective view.

FIG. 4 is a perspective view of a ceramic tile with a saw tooth deflecting front surface.

FIG. 5 is a cross-section view of a disrupting layer including angled ceramic tiles.

FIG. 6 is a cross-sectional view of a projectile impacting composite armor including a cut metal plate.

FIG. 7 is a front view of a cut metal plate.

DETAILED DESCRIPTION OF EMBODIMENTS OF THE INVENTION

Figure 1:
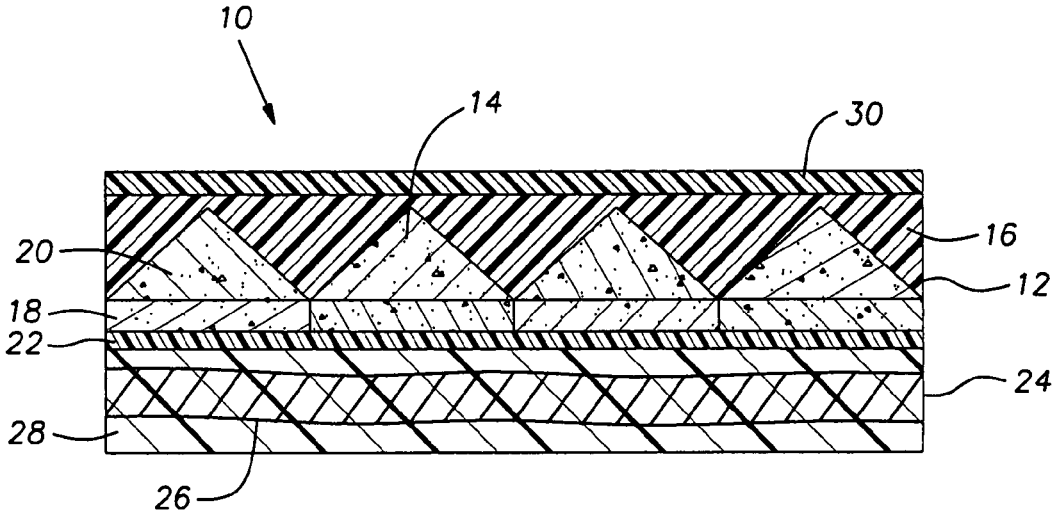
FIG. 1 is a cross-sectional view of composite armor including encapsulated ceramic material.

The present invention provides relatively lightweight composite armor including encapsulated ceramic material that may be used to provide protection from ballistic and overpressure threats. An embodiment of the invention is illustrated by FIG. 1, which provides a cross-sectional view of a composite armor 10 including encapsulated ceramic material. The encapsulated ceramic material is provided in the disruptive layer 12. The disruptive layer 12 is provided to "disrupt" a projectile striking the composite armor 10 through one or more mechanisms, resulting in a dispersal of its kinetic energy. While not intending to be bound by theory, these mechanisms include absorption of the kinetic energy of the incoming projectile by multiple fragments of the disruptive layer (e.g., ceramic fragments) and/or blunting and/or fragmentation of the incoming projectile itself. While the disruptive layer 12 disrupts incoming projectiles, it also provides protection in other manners, such as absorption of blast energy.

Thickness of the disruptive layer depends upon the specific threat. For instance, the thickness of composite armor needed to defeat a 0.30 Cal projectile will obviously less than the thickness needed to defeat 0.50 Cal projectile. For a 0.50 Cal armor piercing threats, the disruptive layer 12 may have a thickness of about 5 to about 60 millimeters (mm) depending upon the composition, density, hardness, packing efficiency etc. High density, high purity alumina ceramic packed to fill the space completely (less than 1% voids that accounts for inter tile spacings) used in the disruptive layer may have thickness in the range of 10 to 30 millimeter. Tiles with deflecting surfaces may have smaller thickness range. On the other hand, in a disruptive layer consisting of packed bed of high density (>95%) high purity (>99%) alumina balls having size of about ¾ inch, the thickness may vary between 30 and 60 mm. Therefore, the dimensions of the armor or armor constituents are most readily described in the context of a specific threat.

As a measure of effectiveness, the areal density of composite armor can be compared with the areal density of a benchmark material such as rolled homogeneous armor steel or rolled homogenous armor (RHA). Since the areal density is directly related to the average density of a layer and its thickness, specification of areal density with respect to that of RHA provides a convenient means of describing armor dimensions. Examples given in this text will illustrate this point. For a specific threat level, the depth of penetration in RHA can be determined experimentally. This value should be determined under conditions that are as similar as possible to the test conditions selected for the armor. If $D_0$ denotes the depth of penetration for RHA, then the critical areal density of RHA will be equal to the density of RHA multiplied by $D_0$. Since $D_0$ denotes the extent of penetration, the total areal density for RHA based armor is taken to be equal to can be taken as the area density of the RHA itself plus the areal density of the backing selected for the test armor. It is assumed that the backing of the test armor is not penetrated so that the comparison of RHA-based armor (including the backing for it) and the armor test panel be used as a figure of merit for that armor. On the other hand, if it is necessary to specify the areal density of the disruptive layer alone, then the reference point will be the areal density of RHA calculated by multiplying its density and the depth of penetration alone.

In the embodiment shown in FIG. 1, the disruptive layer 12 of the composite armor 10 includes ceramic tiles 14 and a retaining polymer 16. The ceramic tiles 14 are preferably adjoining polygonal ceramic tiles 14 that form a layer. Adjoining ceramic tiles 14 need not directly touch one another, but should be close enough to one another that they form a layer consisting primarily of ceramic tile 14. For example, adjoining ceramic tiles 14 may be spaced next to each other with a gap of about 1 mm between them. While too large a gap might allow a projectile to penetrate the armor without impacting a ceramic tile 14, the presence of a gap tends to decrease the number of tiles that are fractured by a single impact.

The ceramic tiles 14 are preferably polygonal; i.e., they include multiple edges or sides. However, additional embodiments of the invention may use ceramic tiles 14 that are non-polygonal, such as hemi-spherical ceramic tiles or spherical particles or granules or pellets. The ceramic tiles 14 may include both a base portion 18 and a deflecting front surface 20. The base portion may have a width from about 30 to about 60 mm. The base portion 18 is preferably shaped to allow the adjoining polygonal ceramic tiles 14 to form a layer with only a small amount of gapping between the ceramic tiles. The base portion 18 preferably has a perimeter that forms a simple polygon such as a triangle, square, or hexagon that allows the ceramic tiles to be placed in a repeating pattern with potentially no gap between adjoining tiles. For example, use of tiles with a hexagonal perimeter allows multiple adjoining ceramic tiles 14 to form a layer with a honeycomb pattern with little gapping between adjoining tiles. The base portion 18 may be flat on the side that faces away from potential incoming projectiles. However, in some embodiments, the base portion 18 may be concave or include a cavity. Providing a concave or cavity-including base portion 18 provides the advantage of reducing the overall weight of the ceramic tile 14 relative to a tile without the concave side or cavity.

The side of the polygonal ceramic tile 14 that faces towards a potential incoming projectile forms a deflecting front surface 20. The deflecting front surface 20 of the ceramic tile 14 should have a shape that encourages the redirection of an incoming projectile from its initial flight path. Preferably, the deflecting front surface has a non-spherical configuration. For example, the deflecting front surface 20 may be conical, pyramidal, or wedge-shaped in order to provide angled surfaces that tend to redirect an incoming projectile so that the new, redirected path is at a non-perpendicular angle relative to the plane formed by the layer of adjoining ceramic tiles 14, i.e., an oblique angle. The angle of inclination provided by the deflecting front surface 20 preferably ranges from about 20 to about 30 degrees. It is also preferable that the angled surface provided by the deflecting front surface 20 be rounded at points or edges that would otherwise be present on the surface. Preferably the incoming projectile is blunted or shattered by impact with a polygonal ceramic tile 14. However, edges of the ceramic tile 14 may require extra thickness to defeat a projectile. In such a case, the deflecting front surface may flare upwards at the edges of the tile. A ceramic tile that flares upwards at the edges will include a ridge that runs around the upper perimeter of the ceramic tile, creating a depression or swale between the edges of the tile and the central conical or pyramidal section.

A steeper angle causes large variations from a critical thickness needed to defeat a projectile resulting in higher areal density. On the other hand, a shallow angle does not provide sufficient projectile deflection, thus requiring a thicker ceramic tile 14. Therefore when the angle is neither to steep nor too shallow, the ability of the tile to deflect an incoming projectile and the need to decrease tile weight are optimal. It has been found that when the deflecting angle is between 15 and 45 degrees and preferably between 20 and 30 degrees, projectiles can be shattered and deflected. Optimizing the configuration of the deflecting front surface of ceramic tiles 14 allows removal of material from the back surface, thus minimizing weight without sacrificing ballistic resistance capability.

Figure 2A:
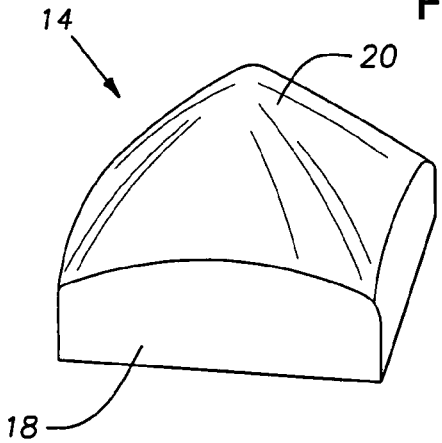
FIG. 2*a* and FIG. 2*b* provide perspective views of a ceramic tile with a square base portion and a conical deflecting front surface, and a ceramic tile with a rectangular base portion and a wedge-shaped deflecting front surface.
Figure 2B:
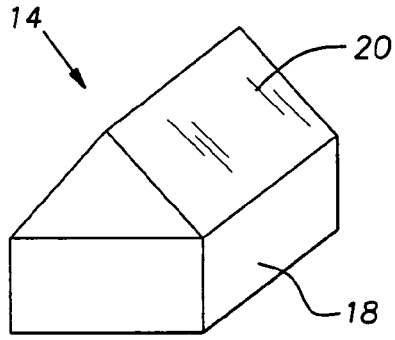

Examples of two differently shaped ceramic tiles that are suitable for use in composite armor of the invention are provided by FIG. 2. FIG. 2*a* shows a ceramic tile 14 with a square base portion 18 and a conical deflecting front surface 20 while FIG. 2*b* shows a ceramic tile 14 with a rectangular base portion 18 and a wedge-shaped deflecting front surface 20. As illustrated by the figures, the deflecting front surface may be include angles that are relatively straight, as shown in FIG. 2*b*, or it may include angles that vary in curvature, as shown in FIG. 2*a*.

Figure 3A:
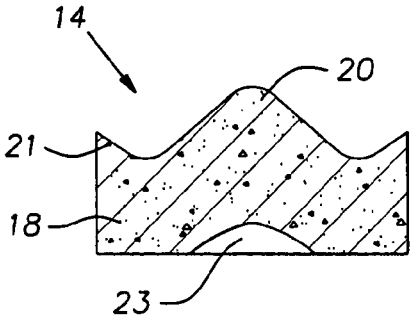
FIG. 3*a* and FIG. 3*b* provide views of a ceramic tile with a square base portion, a conical deflecting front surface, and a flared front edge.
Figure 3B:
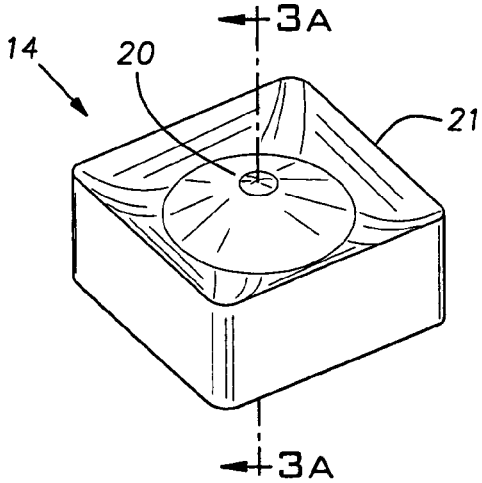

FIG. 3*a* and FIG. 3*b* provide views of a ceramic tile 14 with a square base portion 18, a conical deflecting front surface 20, and a flared front edge 21. FIG. 3*a* provides a cross-sectional view of a ceramic tile, revealing a hollow cavity 23 at the center of the base portion 18 that decreases the thickness in the center region of the ceramic tile 14, while FIG. 3*b* provides a perspective view. A cavity 23 may be provided in the base portion 18 of the ceramic tiles 14. It is preferable that this cavity 23 is similar to an arch or a dome so that it offers structural support.

The flared front edge 21 shown in FIG. 3*a* and FIG. 3*b* provides extra thickness at the edges and corners that otherwise might provide less resistance to an incoming projectile. A deflecting front surface 20 provided with a flared front edge 21 will thus include two basic features; a frustrum of a cone or pyramid in the middle portion of the surface, and a flared front edge 21 that runs around the perimeter of the deflecting front surface. The flared front edge 21 of the deflecting front surface 20 thus forms a thicker rim along outer edges of the ceramic tile 14. The region between the frustrum of a cone or pyramid and the flared front edge thus creates a trough between the center of the tile and the tile edges. The base of the trough will correspond to minimum thickness. When this trough is in a plane parallel to the base, it will not offer as high a probability for deflection for a projectile directly impacting the trough. Thus, it may be preferable to create irregularity in the surface of the trough. For example, the surface of the trough may be allowed to move up or down (undulation) with respect to the plane corresponding the average minimum thickness. This design allows all surfaces to be curved with respect to the direction of the incoming projectile. In particular, the trough may include alternating ridges; i.e., regular or irregular hills and valleys that alternate around its circumference. These hills or ridges may be perpendicular to a tangent off of the trough, or they may be less than perpendicular, as in the case of hills and ridges formed by a spiral pattern of hills and troughs that extend from the center of the deflecting front surface through the trough region.

When using ceramic tiles 14 with a wedge-shaped deflecting front surface 20 such as the tile shown in FIG. 2*b*, it may be preferably to arrange the ceramic tiles 14 so that each wedge-shaped deflecting front surface of each ceramic tile 14 is perpendicular to the wedge-shaped deflecting front surface of adjacent ceramic tiles. Tiles with a wedge-shaped deflecting front surface preferably have a base portion shape (e.g., a square) that allows a layer of ceramic tiles without gaps to be readily formed.

Another ceramic tile 14 that provides a deflecting front surface 20 is shown in FIG. 4. FIG. 4 shows a ceramic tile 14 with a deflecting front surface 20 that has a saw tooth cross section with a 45° bevel angle. When a ceramic tile 14 with a saw tooth deflecting front surface 20 is hit at about 90° to the ceramic surface, it may deflect the projectile as well as fragmenting and blunting the projectile. In this fashion the projectile and its fragments enter the next layer of the armor composition at an oblique angle, allowing the energy to be absorbed along the surface of the armor, rather than directly into the armor. If the saw teeth are small enough relative to the size of the incoming projectile, the projectile may be bisected by one of the saw teeth, resulting in increased fragmentation. A ceramic tile with a saw tooth deflecting front surface also will have less weight than a similarly dimensioned tile that lacks the saw tooth cut. For example, for a inch tile, the presence of a saw tooth cut at a 45° angle decreases the weight of the tile by approximately 25%. While a variety of angles can be provided to create a saw tooth pattern, particularly preferred angles are from about 30° to about 70°, with angles from about 45° to about 60° relative to the plane of the disruptive layer 12 being particularly preferred. When placed on an object (e.g., a vehicle), composite armor 10 including ceramic tile 14 with a saw tooth deflecting front surface 20 should be laid out so that the incoming projectiles are deflected away from the highest value targets within the object (e.g., vehicle).

The ceramic tiles 14 should have a thickness that is sufficient to shatter the projectile and deflect fragments. This thickness is determined by the specific nature of the threat the armor is expected to face, as well as composition, density, mechanical properties, geometry of the ceramic and its shape. As explained above, the thickness of layers within the composite armor can be generally described for a specific threat. The ceramic tiles 14 can be prepared using a variety of suitable ceramic materials. Suitable ceramic materials are light (density less than 4 gm/cc), hard (e.g., hardness preferably greater than that of tungsten carbide), and possess high compressive strength. When a ceramic tile sustains a ballistic impact, the face of the tile experiences high compressive force. Due to their high compressive strength, the ceramics resist compression, and erosion of the projectile tip occurs first instead, followed by failure of the ceramic in tension as the compressive shock wave reaches the back surface of the tile and is reflected as a tensile wave. However, by the time the ceramic fails, it has absorbed energy and has eroded the tip of the projectile so that the projectile cannot easily penetrate subsequent armor layers.

Examples of ceramic materials that are suitable for use in forming ceramic tiles 14 are aluminum oxide, zirconia toughened alumina, precipitation strengthened alumina, magnesium oxide, SiAlON (Silicon oxy-nitride) silicon carbide, silicon nitride, silicon oxide, boron carbide, aluminum borides, and boron nitride, titanium diboride or more generally from a group of oxides, boride, carbides, nitrides of alkaline earth, Group IIA, IIIB, IVB and transition metals and mixtures thereof. In addition, metal matrix composite containing ceramic phase are also suitable. Density of the ceramic is a very important factor in determining its strength. For example, alumina ceramic material is formed into ceramic tiles 14 that have a density greater than 3.5 grams (g)/cubic centimeter (cc), with density ranging from 3.8 g/cc to 3.97 g/cc (or between 95 and 99.9% of theoretical density) are preferred. Although the nature of the specific threat will determine a range of areal densities needed for a particular type of armor, examples given below describe the use of alumina ceramic in a composite armor to defeat 0.50 Cal projectiles with muzzle velocities in the range of 2600-2700 feet/sec. For a high density alumina ceramic tile having a configuration shown in FIG. 2*c*, with density greater than 95% of the theoretical, the ceramic tile 14 layer will have an areal density ranging from about 12 lbs/ft$^2$ to about 22 lbs/ft$^2$. Suitable ceramic tiles can be prepared according to methods known to those skilled in the art, such as by compression molding and sintering or hot pressing. By adopting the strategy of shattering and deflection using shapes described above areal densities of the composite armor will be significantly lower (<50%) than that of rolled homogenous armor (RHA) needed to defeat identical threat level. Other ceramic materials' densities are even lower than that of alumina. For instance, relatively pure (>99%) SiC has a density of about 3.2 g/cc and boron carbide has density even lower than that of SiC which is about 2.8 g/cc. Therefore there are several options to reduce areal densities of armor well below the critical areal density of RHA.

The ceramic tiles 14 used in embodiments of the present invention preferably provide a novel composite armor for defeating ballistic threats in such a way that the areal density of the resultant armor is less than 50% of the areal density of rolled homogeneous armor needed to defeat the same threat. Rolled homogeneous armor is a type of steel armor used as a baseline to describe the effectiveness of armor. The basic concept is that the critical thickness of a ceramic needed to defeat the ballistic threat at zero obliquity is much greater than the thickness needed to defeat the same projectile at a high angle of attack with respect to the surface. If the rear surface is flat while the front surface is angled to cause deflection, there is a variation in thickness that is substantially greater than the critical thickness needed to defeat a specific projectile. The present invention allows the rear surface to vary with respect to the front surface such that excessive armor material is avoided. The reduction of projectile impact is also achieved by incorporating an energy absorbing material such a visco-elastic polyurethane that encloses the ceramic tiles.

Returning to FIG. 1, the disruptive layer 12 of the composite armor 10 includes ceramic tiles 14 as described above, and a retaining polymer 16. The retaining polymer 16 encases the ceramic tiles 14 and completes the disruptive layer 12. The retaining polymer serves primarily to protect the ceramic tiles 14 and help retain them in place. This function may be enhanced by incorporating thin high strength metal wires (tensile strength ~2000 to 3000 MPa) within the retaining polymer. As noted herein, it is desirable to minimize the number of ceramic tiles that are damaged from the impact of an incoming projectile. Strong stress waves produced by the impact can damage tiles adjacent to the impacted tile by propagating through the edges of the impacted tile and into adjacent tiles or by deflection and/or vibration of the backing plate. Stress waves within the disruptive layer 12 can be effectively attenuated within small distances by the retaining polymer 16. A polymeric elastomeric material placed around the ceramic tiles 14 absorbs the stress waves produced by impact, preferably limiting the damage caused by a projectile impact to the tile hit. Unlike metals or ceramics, elastomeric polymers can stretch to many times their original length and retract fully to their original dimensions when the stress is removed. The polymer used as the retaining polymer 16 is selected such that it deforms during impact to result in significant shock dampening. The retaining polymer 16 thus functions to attenuate the shock wave, accommodate the lateral displacement produced by ceramic fracturing, and preserve adjacent tiles during the backing vibration and deformation stage, upon projectile impact.

The retaining polymer 16 encases the ceramic tiles 14. As used herein, the term "encase" means that a significant portion of the ceramic tiles 14 are in contact with the retaining polymer 16. For example, as shown in FIG. 1, a sheet of adjoining polygonal ceramic tiles 14 is encased by a retaining polymer 16 that covers the deflecting front surfaces 20 of the ceramic tiles 14. Preferably, the retaining polymer 16 also flows into gaps provided between the adjoining polygonal ceramic tiles 14. In some embodiments, the retaining polymer 16 may completely enclose the ceramic tiles 14, while in other embodiments portions of the tiles may be exposed or covered by other materials. For example, as shown in FIG. 1, the side of the base portion 18 that faces away from potential incoming projectiles may contact an adhesive layer 22 rather than retaining polymer 16. A variety of polymers are suitable for use in forming the retaining polymer 16. The retaining polymer 16 can be any suitable material that retains elasticity upon hardening at the thickness used, such as an elastomer (e.g., rubber), an epoxy, a thermoplastic polymer, or a thermoset plastic. A preferred polymer for use in forming the retaining polymer 16 is polyurethane and its derivatives (e.g., visco-elastic polyurethane and polyurethane elastomers belonging to the family of materials described in U.S. Pat. No. 7,078,443, issued to Milliren, which is hereby incorporated by reference herein.

In some embodiments of the invention, the retaining polymer 16 may also include fire-retarding particles. The fire-retarding particles are relatively small pieces of material that absorb energy upon heating, which helps mitigate the effects of blast or other forms of energy release into the composite armor 10. Fire-retarding particles include water-containing materials that help absorb energy by taking advantage of the relatively high specific heat ($C_vH$=74.539 J mol$^{-1}$ K$^{-1}$ (25° C.)) of liquid water. Examples of material that may be used in fire-retarding particles includes alumina or magnesia hydrate, zinc borate, perlite and vermiculite. In addition to including water, both of these materials expand substantially upon being heated. Perlite is an amorphous volcanic glass composed primarily of silicon dioxide ($SiO_2$) and aluminum oxide ($Al_2O_3$) that softens and releases water when it reaches temperatures of 850-900° C., expanding to 7-16 times its original volume. Vermiculite is a mineral with the formula $(MgFe,Al)_3(Al,Si)_4O_{10}(OH)_2.4H_2O$ that also expands significantly upon application of heat. In addition to absorbing additional energy, expansion of the fire-retarding particles can minimize damage to the ceramic tiles 14 resulting from blast or projectile impact, and can help seal ruptured composite armor 10 to decrease loss of components. Preferably, the fire-retarding particles have a diameter ranging from 0.1 mm to 3 mm. Fire-retarding particles can readily be mixed into the retaining polymer 16 by means known to those skilled in the art.

In embodiments of the invention using ceramic tiles 14 that include a cavity 23, the cavity 23 may be filled with fire retarding material to enhance the ability of the composite armor to absorb blast energy. This fire retarding material may include any of the materials described herein for use in fire retarding particles. In addition, the fire retarding material placed within the cavity 23 may include additional materials that are not suitable for forming particles, such as liquids (e.g., water) that have a high capacity for absorbing energy. Fragmentation of ceramic by projectile impact will result in an ultra-fine dispersion of fire suppressant liquid, which will effectively quench blast energy such as that produced by a fire ball.

Returning again to FIG. 1, the composite armor 10 also includes a backing layer 24 adjacent to the disruptive layer 12. While the disruptive layer 12 disrupts incoming projectiles in part by fragmentation and/or alteration of their flight path, the backing layer 24 complements this role by preventing or decreasing penetration of the composite armor 10 by the disrupted blast or projectile by absorbing its kinetic energy. The kinetic energy is absorbed through a variety of mechanisms, including fiber/wire strain and fracture, fiber/wire pullout, and composite delamination. The backing layer absorbs the debris created by projectile impact in order to avoid penetration of the backing surface. The backing layer is supported at the edges in such a way that its flexural deformation allows energy absorption of the debris and reduction in momentum is prolonged thereby reducing the impact force. The backing layer 24 also tends to carry the bulk of the load when the armor is used to provide structural support in addition to ballistic and blast protection.

The backing layer includes a reinforcement 26 encased by a polymer, referred to herein as the backing polymer 28. The backing polymer 28 can be an elastomer (e.g., rubber), an epoxy, a thermoplastic polymer, or a thermoset plastic. As with the retaining polymer 16, a preferred polymer for use in forming the backing polymer 16 is polyurethane or its derivatives. As in the case of the disruptive layer, thickness of backing layer depends upon the specific nature of threat, characteristics of disruptive layer, mechanical properties and composition of the backing layer. For example, as described in the examples, backing layers can be formed from metals, fiber-glass, and/or metal wire reinforced polymers. If the disruptive layer shatters and deflects fragments over a broader area then the backing layer has to have sufficient strength and penetration resistance to catch these fragments and decelerate them without letting them penetrate the backing layer significantly. For example, to defeat 0.50 Cal projectiles with a muzzle velocity in the range of 2600-2700 feet/sec, a backing such as HHA (High-Hard Armor Steel) having an areal density (proportional to average density and thickness) in the range of 3-10 lbs/ft$^2$ is sufficient to prevent penetration after the projectile has been shattered and or deflected by the disruptive layer. Preferably, the backing layer has a thickness ranging from about 0.1 inch to about 0.25 inch.

The backing polymer 28 encases a reinforcement 26 formed from fiber or metal wires. Wires may be provided as a single strand, or as a braided cord. Preferably the reinforcement 26 is completely encased with backing polymer 28. The fiber or metal wires may be woven together to form a pattern, or they may be randomly tangled in a fashion similar to that exhibited by a random coil. Preferably, the reinforcement has an ultimate tensile strength of 2500 to 3200 MPa. If woven into a pattern, the fibers or wires may be woven as described in U.S. Pat. No. 4,868,040, issued to Hallal et al., which is hereby incorporated by reference herein. As described by Hallal et al., the wire or fibers should be given a weave that interferes as little possible with the tensile strength of the wires or fiber, and multiple layers of woven material may be rotated from 0° to 90° relative to one another to maximize the desired properties, with a 0/90° orientation being generally preferred.

If fiber is used to form the reinforcement 26, a variety of high tensile strength fibers may be used. For example, the fibers may be made of an inorganic fiber such as a glass or ceramic, or organic fibers may be used. Examples of suitable organic fibers include polyethylene, polyparaphenylene teraphthalamide, and aramide. In addition, high tensile strength carbon or carbon nanotube fibers may be used. If wire is used to form the reinforcement 26, a variety of high tensile strength metals or metal alloys can be used to form the wire, such as tungsten, titanium alloy, or steel. Preferably, the metal is a ductile metal such as stainless steel.

An adhesive layer 22 may be provided between the disruptive layer 12 and the backing layer 24. The adhesive layer 22 adheres the two layers together. Use of an adhesive material to adhere the disruptive layer 12 to the backing layer 24 is particularly helpful when the disruptive layer 12 includes ceramic tiles 14 that expose ceramic of the backing portion 18 that is not encased by polymer. The adhesive layer 22 may be formed using an elastomer (e.g., rubber), an epoxy, a thermoplastic polymer, or a thermosetting polymer, preferably with reinforcement. A preferred polymer for use in forming the adhesive layer 22 is polyurethane. Note that while the adhesive layer 22 functions in part to adhere the disruptive layer 22 to the backing layer 24, it may provide other functions as well. For example, the visco-elastic material used to form the adhesive layer 22 may help absorb the kinetic energy of projectile or blast impact, and help preserve the ceramic tiles 14 used in the disruptive layer 12.

A final, optional, spall layer 30 is provided in some embodiments of the invention. A spall layer 30 may be provided to contain fragments (e.g., ceramic fragments) resulting from an impact on the disrupting layer 12. Containing the fragments increases the ability of the composite armor 10 to offer resistance to penetration even if hit at or near the same location as a previous blast or projectile strike. The spall layer 30 is not intended to provide significant resistance to initial armor penetration when struck by a projectile. However, the spall layer 30 effectively contains the diffused back-blow of fragments, as their kinetic energy is significantly lower than that of the original projectile.

The spall layer 30 may be a synthetic plastic sheath, a thermoplastic sheath, a polycarbonate sheath, or a polymer-encased reinforcement. If a polymer-encased reinforcement is used, the spall layer may include high tensile strength fine steel wire mesh or fiberglass embedded in polymer layer. Alternately, the spalling layer 30 may be a self-sealing material which closes upon a punctured hole created by an incoming projectile so that size of the hole is smaller than the size of most of the ceramic tiles or tile fragments remaining within the disruptive layer 12. Self-sealing materials may be selected from a group consisting of vulcanized rubber including disulphide rubber, polyurethane elastomers, silicone, butyl rubber etc. Preferably, the spall layer 30 has an areal density in a range of about 0.1-3 lbs/ft$^2$.

Composite armor 10 provides protection against a variety of blast and ballistic threats. For example, composite armor 10 according to the invention is capable of preventing penetration by 0.50 caliber armor piercing incendiary steel core projectiles fired at a velocity of 2500-2700 feet/sec, as well as 20 mm fragment simulation projectiles (FSP) fired at a velocity of 3600 feet/sec. The 20 mm FSP round corresponds to size and kinetic energy of over 90% of the fragments originating from a 152 mm Russian artillery shell detonated at about 2 meters, which represents a typical IED threat or other nearby artillery blast.

Composite armor 10 of the present invention provides numerous advantages such as improved protection against blast and ballistic threats, multi-hit capability, and low areal density. Preferably, the composite armor 10 provides armor with an areal density of 50% or less compared to the areal density provided by a similarly-sized armor plate fashioned from rolled homogenous hardened steel. For example, the composite armor 10 may have an overall areal density of 25 lbs/ft$^2$ or less or 50% of areal density of RHA needed to defeat 0.50 Cal projectiles fired at 2600-2700 feet/sec.; typically about 20 to about 22 lbs/ft$^2$ to defeat ballistic threat mentioned above. The composite armor 10 may be used to provide protection for vehicles, crafts, buildings, and personnel. The composite armor 10 may be integrated into the vehicle or structure when it is originally built, or may be provided later as an "add-on." When provided as an add-on, the composite armor 10 will be provided with clips and hinges or brackets (or other suitable fittings), typically on the backing layer 24, to allow the composite armor 10 to be placed on a vehicle where it can protect the vehicle and/or its occupants from blast and ballistic threats. For example, the composite armor 10 may be fitted to be placed over a vehicle door, or placed on a vehicle underbody. In particular, the composite armor 10 is suited for placement on light military vehicles such as the HMMWV that might not otherwise have sufficient protection against heavy caliber ammunition or IEDs.

Advantages of the multi-layered structure include deflecting crack propagation in a direction normal to the incoming projectile, thereby dissipating energy that causes the fracture processes. The use of confining materials such as fiber reinforced composites (e.g., metal reinforcement composites or light metal alloys) can define fractured segments. Composite armor panels can be molded to provide a desired shape other than a flat panel, if desired. Other advantages of the multi-layered structure include the ability to readily carry out armor repairs in the field because such composite pieces can be fabricated in modular shapes. These modular pieces can then be easily attached using adhesives or fittings.

Additional Embodiments of the Invention

Composite Armor Including Angled Ceramic Tiles

In a further embodiment of the invention, the disruptive layer 12 includes ceramic tiles 14 with have been placed within the disruptive layer 12 at an oblique angle relative to the plane formed by the disruptive layer. This embodiment is illustrated in FIG. 5. An oblique angle is any angle between 0° and 90°; however, angling the ceramic tiles 14 at an angle of about 30° to about 70° is preferred. In this embodiment, the ceramic tiles 14 do not typically include a separate deflecting front surface 20 or backing portion 18. The ceramic tiles 14 may be formed from any of the ceramic materials described herein. Alternately, the "ceramic tiles" may be replaced with sheets of hardened metal, such as steel armor plate. The ceramic tiles 14 may be separated by intervening polymer spacer 32 layers, as shown in FIG. 5, or the ceramic tiles 14 may be held at an oblique angle within the disruptive layer 12 by an encasing retaining polymer 16. The retaining polymer 16 may be any suitable visco-elastic polymer.

Upon ballistic impact, the leading edge of composite armor 10 including angled ceramic tiles 14 undergoes fracture and deformation in such a way that the projectile's orientation and path are altered. The basic principle is based on utilizing conservation of linear and angular momentum such that sacrificial armor components are allowed to fracture and move causing the projectile to alter its original trajectory as well as its original angular orientation or its yaw angle.

Composite Armor Including Cut Metal Plate

Composite armor including cut metal plate provides an additional layer of cut metal beneath the ceramic tiles of the disruptive layer. FIG. 6 provides a side, cross-sectional view of composite armor including cut metal plate being struck by a projectile. The composite armor 10 shown includes ceramic tiles 14 that form a layer. Underneath the ceramic tiles is a layer of cut armor plate 34. Behind the cut armor plate 34 is at least one energy absorbing layer 36. The energy absorbing layer or layers may be formed using fiber-reinforced plastic (the reinforcement being Kevlar), high density polyethylene, glass fiber or high strength metal fiber, or reinforced aluminum. An optional additional layer of armor plate 34 (cut or not cut) or ceramic tile 14 may be provided within energy absorbing layer 36 (not shown). Optionally, a backing layer 37 may also be provided behind the energy absorbing layer 36. Typically the backing layer 37 is an additional layer of metal or fiber that catches fragments that have penetrated the energy-absorbing layer.

The figure also shows an incoming projectile 38 that is about to impact the composite armor 10, and a deflected projectile 40 subsequent to impacting the composite armor 10. FIG. 6 also illustrates the function of the armor plate, showing how a deflection tab 42 folds inward to encourage deflection of the projectile 40, so that it travels into the remainder of the composite armor 10 at an oblique angle.

The ceramic tile 14 layer is formed of a plurality of adjoining polygonal ceramic tiles. The tiles may have any suitable ceramic tile shape disclosed herein. For example, the ceramic tiles may have a backing portion 18 and a deflecting front surface 20. The tiles may be formed from any suitable hard ceramic. The ceramic tiles 14 may be placed directly on the face of the composite armor 10, or they may be encased in a retaining polymer.

A front view of a sheet of cut armor plate 34 is provided by FIG. 7. The armor plate 34 has been cut so that it includes a plurality of deflection tabs 42. While the deflection tab 42 shown is generally rectangular, other shaped deflection tabs 42 may also be used, such as triangular or hemi-circular, so long as the deflection tab is able to open at one end and bend along a hinge at the other end. The rectangular deflection tabs 42 shown in FIG. 7 may be formed by providing one or more end cuts 44 and side cuts 46. The end cuts 44 should form a line segment that bisects a portion of the armor plate 34 without actually reaching either side of the armor plate 34. When a plurality of end cuts 44 are present, they are preferably about parallel to one another. Extending from and perpendicular to the end cuts 44 are a plurality of side cuts 46. The uncut end of the deflection tab 42 formed by the combination of end cuts 44 and side cuts 46 forms a hinge region 48, which is where metal forming the deflection tab 42 bends when a tab is struck by an incoming projectile. The rectangular deflection tabs thus formed may have a variety of sizes. For example, the deflection tabs 42 may be between about 1 inch and 3 inch wide and between about ½ inch and 2 inch long.

Alternately, in a simpler embodiment, only end cuts 44 are formed in the armor plate 34. While this does not result in the formation of discrete deflection tabs 42, it will encourage the armor plate to open inwards along the end cut 44 when the armor plate 34 is struck by a projectile, which will still tend to deflect the incoming projectile 38 along an oblique angle.

While any suitably hard yet ductile metal can be used to form the armor plate 34, a preferable metal is steel. The cuts used to form the deflection tabs may cut through the entirety of the steel plate, or they may penetrate only partially to form a weak spot. Alternately, the cuts may be perforated regions of the metal in which cut and uncut metal alternate to form a weak spot. Preferably, the end cut 44 is cut entirely through the armor plate 34, while the side cuts 46 are perforated cuts. The metal may be cut using a laser, or any other suitable metal cutting technology known to those skilled in the art.

An incoming projectile 38 fired at the composite armor 10 including cut metal plate first comes in contact with the ceramic tiles 14, which shatter and/or blunt the projectile 38. As the projectile passes through the ceramic, it deforms the armor plate 34 by bending in one or more of the deflection tabs 42. Some energy is absorbed by the deformation and/or tearing away metal in the perforation of the side cuts 46 along the sides of the tab. Instead of penetrating the tab, the projectile 40 is deflected and enters the energy absorbing layer 36 of the composite armor 10 in an oblique fashion.

In an exemplary embodiment that may be used to defeat 0.50 caliber (Cal) projectiles fired at a velocity of 2600-2700 feet/sec, the composite armor 10 includes a ceramic tile 14 layer that is between 0.18 inch and 0.5 inch thick; a steel (typically rolled homogeneous armor) armor plate 34 of between ⅛ inch and 0.37 inch thick; and an energy-absorbing layer formed of a composite between ¼ inch and 3 inch thick.

Composite Armor Including Strengthened Glass

Ballistic tests on ceramic tiles have shown that there are at least two types of fracture processes that contribute to the failure of a ceramic material and partially absorb energy of a projectile. One process involves a cone type fracture propagating from the front surface of the ceramic while the other involves a fracture on the opposite side. Fracturing on the opposite side is generally the result of flexural strain which causes high tensile stresses in the material. It is desirable to increase the strain tolerance so any fracturing on the backside of the tile is delayed. Traditional ceramic materials used for armor applications have high elastic modulus and are strain intolerant. As a result, stress build up to fracture stress occurs quickly when the ceramic layer is impacted by a projectile.

An additional embodiment of the composite armor 10 described herein includes a layer of glass materials which have a lower elastic modulus and allow greater deflection. Because ordinary glasses (e.g., silicate glasses) are considerably weaker than sintered ceramics, the glass materials used in composite armor 10 are strengthened by processes such as thermal or chemical tempering (e.g., ion exchange strengthening). The high compressive stresses imposed by chemical tempering increase the fracture strength by a factor of about 5 to about 20 depending upon the processing conditions and glass compositions. For example, it has been observed that the strength of ordinary soda-lime-silica glass can be increased from 5000-10,000 psi to 80,000-100,000 psi range using chemical tempering. Treated glass shows improved resistance to strength degradation from surface damage, and often exceeds the strength of most commonly available polycrystalline monolithic ceramics. Use of such treated glass in composite armor can thus delay fracture propagation processes and fracturing on the backside, as described above.

Figure 8:
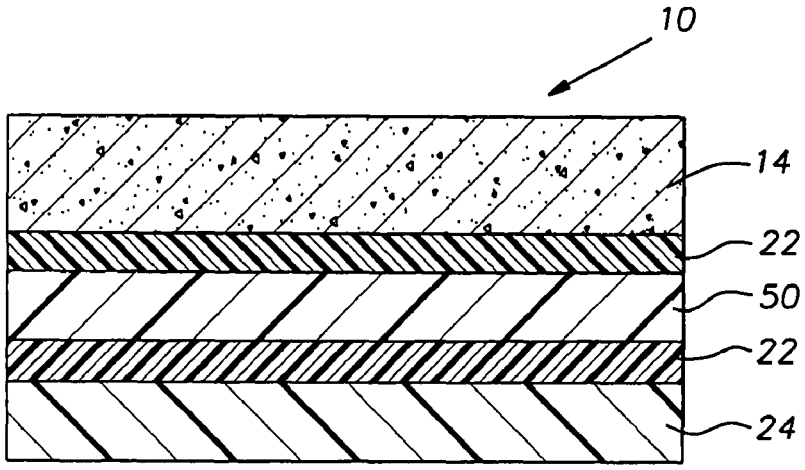
FIG. 8 is a cross-sectional schematic side view of composite armor including a layer of strengthened glass.

A composite armor including a layer of strengthened glass is shown in FIG. 8. The composite armor 10 includes a layer of ceramic tile 14, adhesive layers 22, and a backing layer 24. The natures of these layers have been described herein. Between the ceramic tile 14 layer and the backing layer 24, a strengthened glass layer 50 is provided between two adhesive layers 22. The strengthened glass layer 50 can include a sheet of strengthened glass or glass-ceramic in either its final formed shape or in modular form so as to provide the desired shape.

An advantage to including a glass layer in composite armor is that glasses are easy to form into complex three dimensional shapes. Glass can be easily integrated into forming multi-layered composite structures with fiber-reinforced backing and adhesive layers to produce a final structure that can be fitted with an outer shell of discrete ceramic elements. Glass or glass-ceramic can be shaped first and then strengthened by ion exchange process to improve its strength.

Composite Armor Including a Layer of Ceramic Granules

Another embodiment of the composite armor of the invention includes a layer formed from a packed bed of ceramic granules. The term ceramic granules is used broadly herein to denote a self-sustaining body of ceramic or mostly ceramic phase having dimensions in the range of 1 mm to 30 mm and preferably in the range of 6 mm to 20 mm, and includes shapes such as beads or pellets. In particular, the granules may be spheroidal or ovoid shapes selected for their flowability. The bed of ceramic granules are shaped or packed in such a way that particle to particle contact and a controlled pore structure for infiltration by suitable metal or alloy such as aluminum, titanium, magnesium, combinations thereof and the like is provided.

The ceramic granules can include tabular alumina, silicon carbide grains, fused alumina grains, sintered boron carbide grains, sintered alumina, silicon carbide, boron carbide, titanium diboride-aluminum composite, and/or ceramic materials (e.g., oxides, carbides, nitrides, or borides of aluminum, magnesium, silicon, or mixtures thereof) selected for the disruptive layer described above or combinations thereof. The grains can be made by electro-fusion in arc furnace, extrusion and sintering or any suitable low-cost manufacturing method. It is desirable that the process employed yields granules with a matrix that is at least 70% dense and preferably more than 95% dense. The granules can be subsequently bonded by a frit that melts and/or coats the granules and segregates the granules at the contact points leaving sufficient inter-granule porosity for which a metal could infiltrate or reside. Preferably the porous granules are prepared by mixing the granules in a slurry containing frit (e.g., alumino-silicate glass or other suitable composition with melting point higher than the temperature of metal used for infiltration and which will wet particles) with solids about 2-10% by volume and heating the mixture in a suitable non-wetting mold such as graphite. After heating the slurry above the melting point of the frit for a sufficient period of time to allow the frit to melt and coat the granules, the slurry is allowed to cool down. The result is bonded granule matrixes with porosity in excess of 5% which can be infiltrated by a suitable metal such aluminum. Infiltration can be accomplished by casting. Special additives can be used to increase the wettability of the ceramic granules to a metal. For example, titanium can be added to aluminum to improve wettability of aluminum towards silicon carbide and improve its adhesion.

Figure 9:
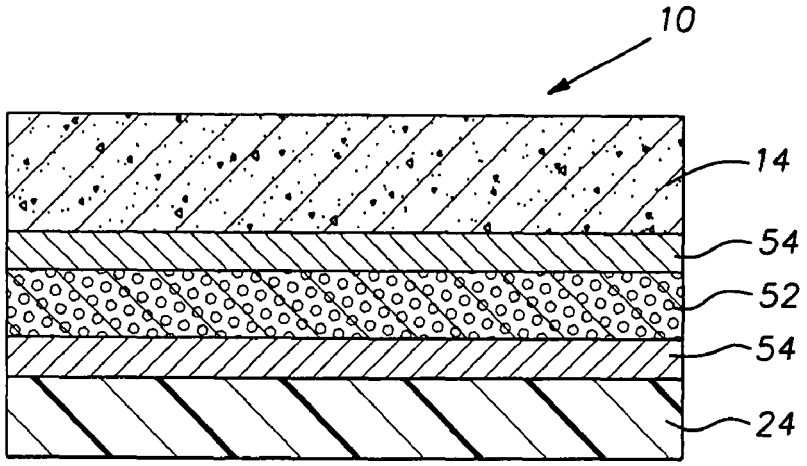
FIG. 9 is a cross-sectional schematic side view of composite armor including a layer of a packed bed of ceramic granulates.

A composite armor including a layer of a packed bed of ceramic granules is shown in FIG. 9. The composite armor 10 includes a layer of ceramic tile 14, adhesive layers 22, and a backing layer 24. The nature of these layers have been described herein. Between the ceramic tile 14 layer and the backing layer 24, a ceramic particle layer 52 is provided. Preferably, the ceramic particle layer 52 is provided between two confining layers 54. The confining layers 54 are formed of materials such as metal or fiber reinforced composites (e.g., metal matrix composites or light metal alloys) that help confine the fractured segments that typically result from a projectile impact.

FIG. 9 shows layer 14 above layer 52. However, the position of these layers may be interchanged so that the incoming projectile strikes the packed bed of granules before hitting the underlying tiles. According, in another variation the location of ceramic tiles and packed bed of granules are interchanged. Since the granules preferably have a size that is comparable to that of the projectile and since their shape is either spherical or substantially curved, there is a very high probability that the projectile will meet an inclined surface and get deflected. Furthermore, the packed bed of granules may also shatter or fragment the projectile. Heavier fragments will be then be slowed and defeated by the underlying layer of ceramic tiles.

Some advantages of the above-described process for preparing a ceramic particle layer 52 are that it increases manufacturing flexibility and is less expensive than fabricating monolithic ceramic of equivalent size and shape. Advantages associated with the use of a packed bed of ceramic granules include ease of fabrication, modular design for variable threat level, and flexibility in trade-offs of ballistic resistance and weight. In addition, in fabricating a component with complicated shapes, shape adaptability of this layer becomes very important.

In a further embodiment, the composite armor 10 includes a shell filled with ceramic particles such as tabular alumina, sintered ceramic materials suitable for the disruptive layer as described earlier, combinations thereof and the like. One advantage of the shell is its ease of use with armor applications. The shell wall, which functions in part to provide spall protection, may one or more elastomers, e.g., neoprene, polyurethane, butadiene, butyl or silicon rubber, with or without reinforcement by a ballistic fiber; and/or a light-weight metal. Metallic shells can be made out of toughened metal such as heat treated ferrous alloys and non-ferrous alloys such as titanium. The shells can be filled with ceramic granules such as tabular alumina, boron carbide, silicon carbide or more generally sintered ceramic granules having a composition selected from the group of materials used for disruptive layer. Preferably the shell is filled with such powders to at least 60-95% of its capacity. Multiple shells can be used in a modular fashion to construct an armor to meet a specific threat level. Ballistic resistance can be increased by using multi-layered shells having overlapping bodies with no directly exposed seams. The performance of the shell can be enhanced by laminating it with a suitable ceramic tile such as alumina, silicon carbide, boron carbide, glass-ceramic, materials selected for the disruptive layer, combinations thereof and the like.

Figure 10:
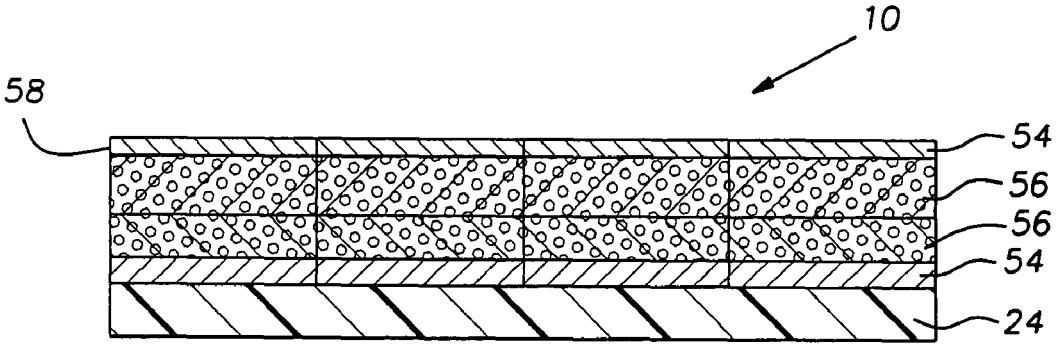
FIG. 10 is a cross-sectional schematic side view of composite armor including a ceramic particles within a shell.

FIG. 10 provides a side schematic view of composite armor including a metallic shell filled with ceramic granules. In the composite armor 10 shown in FIG. 10, a ceramic granule layer 56 is encased in a shell or shells 58 (e.g., cans or cylinders) with two confining layers 54 (upper and lower) trapping or confining the ceramic granules within the shells 58. The granule-filled shells 58 are arranged in such a way that they substantially or completely cover a surface to be protected. The shells 58 are supported by a backing layer 24 that serves as a catch layer. The shells 58 may be square, hexagonal or any other desirable shape or mixtures of shapes that provide complete coverage of the area to be protected. The shells 58 and the enclosed confining layers 54 and ceramic granules may be provided in a modular fashion.

The upper confining layer 54 may be formed from materials such as a thin sheet of metal, wire screen, Kevlar/epoxy composite, fiber-glass reinforced plastic, or ballistic fiber or metal wire reinforced elastomers. One function of the upper confining layer 54 is to prevent granule blow out after projectile impact. The lower confining layer 54 may be formed from one or more materials such as lightweight metals such as aluminum, titanium, or their alloys, intermetallic compounds and/or polymers (e.g., polycarbonate) or polymer composites (e.g., fiberglass composite, laminated polycarbonate). The lower confining layer 54 functions in part to catch fragments and provide mechanical support for the ceramic granule layer 56 and to resist the thermal effects of hot fragments after projectile impact.

The ceramic particular layer 56 includes ceramic shapes such as spheres, pyramids, cylinders, disks, and/or rings. The ceramic used is preferably intrinsically dense (>90% of theoretical density). If the shape is a ring, the preferred density of the wall is greater than 90%. The ceramic shapes can be coated with a thin layer of softer coating. This coating can include one or more polymer, a different, typically softer ceramic material, and/or a metal. The ceramic shapes are preferably spherical or ovoid. Shapes having a variety of sizes may be used. For instance, shapes may be sized so that the packing density is higher in the lower section than the upper section. When layers of granules having different sizes are used, the size of shapes in the upper layer is preferably greater than the size of those in the lower layer. The ceramic shapes in the upper layer preferably have a size in the range of 0.25 inch to 1 inch. The ceramic granules may be used alone, or may be embedded in a high porosity reinforcement such as polyurethane foam, EPS, EPP, etc. or mixed with other flexible materials such as rings of metals or chopped wires. One function of the ceramic granule layer 56 is to disrupt an incoming projectile by shattering it or slowing it sufficiently that the lower confining layer 54 and the backing layer 24 are not penetrated by fragments from the projectile.

The backing layer 24 in this embodiment of the composite armor may be a relatively thick sheet including one or more of the materials selected from light-weight metals or alloys in solid sheet, chains, mesh or honeycomb form and/or polymer composites containing reinforcements such as Kevlar, Dyneema, glass fibers or thin sheets of metals like titanium, high strength aluminum or its composites, RHA, HHA (High Hard Steel—a type of armor steel that is industry standard). The backing layer 24 generally functions in a fashion similar to that of the lower confining layer 54 except that it generally does not provide significant resistance to thermal effects.

An advantage of composite armor using ceramic granules enclosed in shells is that it can be easily serviced in the field. The composite armor can be assembled in the field by employing modules that can be fastened to a vehicle. In addition, it provides a specific regional density lower than that of steel or aluminum armor for a equivalent threat level, is readily fabricated, has a modular design that allows adjustment for variable threat levels, and provides flexibility in trade-offs between ballistic resistance and weight.

Composite Armor Including a Renewable Ceramic Granule Layer

This embodiment provides a composite armor in which the incoming projectile is disrupted primarily by a loosely-filled container filled with flowable ceramic granules. It should be noted that the granules cover a wide range of size and shapes as described earlier with regard to composite armor including a ceramic granule layer. The ceramic granules are held by an open-faced metallic or composite frame, forming a ceramic granule layer, and retained in the frame by a cover layer made of one or more materials such as metals, metal composites, polymer composites, ballistic fiber based composites, impact resistant polymers such as polycarbonate, or fabric made out of ballistic fiber. Upon projectile impact, the cover layer is punctured, forming an entrance hole. However, the cover layer limits the entrance hole to a size smaller than the size of the ceramic granules, preventing their outflow through the entrance hole. As the composite armor is struck by bullets and/or other projectiles, ceramic granules flow to fill the gap or void created in the ceramic granule layer by projectile impact. Ceramic granules within the granule layer also become fractured after impacts, leading to an increase in the packing density within the granule layer. As the packing density increases, the volume of the granule layer decreases. However, flowable ceramic granules may be supplied from nearby reservoirs or an external source in order to renew to granule layer.

Composite armor including a renewable ceramic granule layer may be supplemented by a layer of adjoining ceramic tiles encased in a retaining polymer, as described above. This additional layer may be placed either above or below the renewable ceramic granule layer, relative to the direction of a potential incoming projectile.

Figure 11:
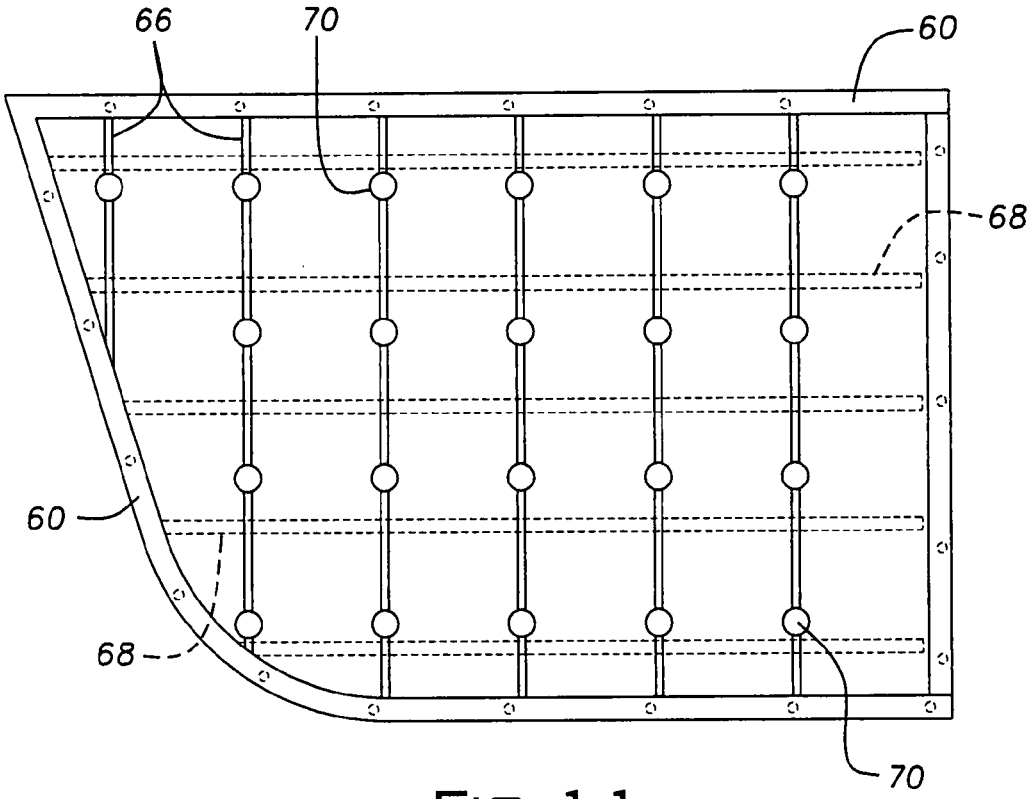
FIG. 11 is a rear view of composite armor with a renewable ceramic particle bed configured for mounting to a vehicle door.
Figure 12:
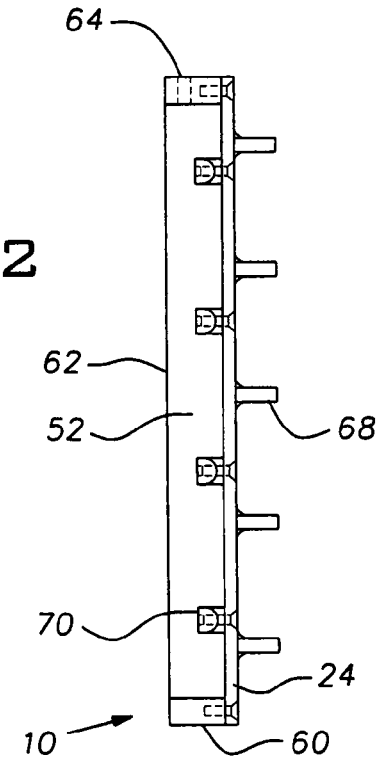
FIG. 12 is a side view of composite armor with a renewable ceramic particle bed configured for mounting to a vehicle door.

FIGS. 11 and 12 illustrate a composite armor 10 including a renewable ceramic granule layer 52 configured to be fitted to a HMMWV door (lower half). The frame 60 makes up a cavity that is filled with a ceramic granule layer 52 formed of flowable ceramic granules that are retained by a cover layer 62. The frame 60 has one or more refill openings 64 that are connected to a reservoir of granules that can flow into a vertical cavity as its packing density changes upon impact. Preferably the refill openings 64 are provided along the top edge of the composite armor 10 to facilitate adding ceramic granules when the composite armor has been positioned on a vehicle, though openings in the side are also suitable, particularly when the composite armor is placed on the top or underside of a vehicle. The composite armor 10 also includes webs 66 within the frame 60 that serve to isolate the ceramic granules into separate sections within the frame 60. Supports 70 may also be provided that connect the webs 66 to the back plate 24. The frame 60 and webs 66 are preferably of the same height and the two surfaces provided by the back plate 24 and the cover layer 62 form a series of vertical cavities between the webs 66 in which free flowing ceramic granules are placed to form a closed packed layer. Behind the back plate 24, one or more stiffeners 68 are provided. The stiffeners 68 provide additional support for the composite armor 10.

The cover layer is designed so that the entrance hole created by a projectile impact "heals" quickly and limits its size. Preferably, the cover layer includes a double layers or sheets of fiberglass, aluminum laminate containing a layer of adhesive elastomeric material in the space between the two sheets. In order to reduce the flowability of the granules to reduce leakage through an opening created by a projectile, the dimensions or size ratio of the granules is preferably about 3:1. At this ratio, the flowability of the granules through an opening, such as a projectile opening, is impeded. Leakage of free-flowing balls or granules through projectile entrance holes is thereby restricted.

Ceramic granules are preferably spherical or substantially spherical, ovoid, or similar shapes that can readily flow past one another. Granule flow may be aided by the vibrations expected in a moving vehicle. The ceramic granules used preferably have a strength and hardness sufficient to cause fragmentation of an incoming projectile. For example, a 0.50 caliber armor piercing projectile with a hardened steel core can be shattered by alumina spheres that have a diameter in the range of 0.25 inch to 1 inch and require a crushing load in excess of 3000 lbs and preferably in excess of 4000 lb. The ceramic granules can be coated with a layer of softer material so that the maximum tensile stress at contact is reduced when subjected to an equivalent load. The softer material may be a polymer, metal or a composite of polymer, metal and/or a ceramic. As a result of including such a coating, the ceramic granules will be able to withstand much higher loads before fracturing.

The ceramic granules are preferably spherical or spheroid and are capable of flowing into vacant space on account of their weight and/or when subjected to suitable mechanical means such as vibrations. Preferably, the granules have crushing loads in excess of 3000 lbs and preferably above 4500 lbs. The size of the granules should be greater than the diameter of projectiles that the armor is intended to protect against so that the loss of ceramic granules through an entrance hole formed by projectile impact is decreased or eliminated.

A preferred feature of this embodiment is that the granules are coated with softer (with respect to hard ceramic like alumina, SiC) polymeric materials that have interfacial high bond strength with respect to the substrate. Dynamic impact force measurements conducted on panels with ¾ inch alumina balls and ½ inch aluminum base showed that the coated balls reduced the impact force from about 20000 pound-force (lbf) to about 10000 lbf, an unexpected reduction in the impact force which will increase the effectiveness of the armor. For example, in one embodiment, ¾ inch balls+¼ inch alumina tile placed inside 3 inch diameter 2 inch high steel ring, with polyurethane reinforcement in the interstitial space. The entire assembly is contained in Kevlar along with 2 inch aluminum cylinder. This embodiment of composite armor resulted in a first impact peak force=27208 lbf. A second embodiment of the composite armor is the same as above except, all ¾ inch balls are coated with polyurethane elastomer. In this case, the first impact peak force=11347. These values are representative of the extent to which impact force is reduced. Actual values will depend upon a number of factors including type of armor, composition of damping material, geometry of test cell, etc. However when compared under identical conditions, effect of damping by reduction in force is clearly measurable.

The armor thickness and proposed structure can be altered to meet a variety of different threat levels. This form of armor has several advantages beyond its ability to self-renew. These advantages include providing a specific regional density lower than that of steel or aluminum armor for an equivalent threat level, being readily fabricated, flexibility of design to meet variable threat levels, and flexibility in trade-offs between ballistic resistance and weight.

The composite armor 10 of the invention may include additional, repeated layers of specific layers described herein. Additional layers within the armor can be repeated or provided in depth until sufficient protection against the desired threat level is achieved. For example, the composite armor may be provided with multiple backing layers. Furthermore, the layered structure of the composite armor is not limited to the precise sequence of layers described in the embodiments shown above.

Several embodiments of the present invention are illustrated by the following examples. It is to be understood that the particular examples, materials, amounts, and procedures are to be interpreted broadly in accordance with the scope of the invention as set forth herein. For instance, although the ceramic tiles or granules in the examples are high purity alumina ceramics, similar results can be obtained by using other materials described above.

EXAMPLES

Ballistic Testing: All tests were carried out by using a Barrett 0.50 Cal rifle placed at a distance of about 35-40 feet from the target. Projectile velocity was measured by using two chronographs. An armor panel was secured in an aluminum picture-frame type support and the frame was placed in front of a bullet trap. A witness plate was placed between the aluminum frame and the bullet trap. After the test, the panel and witness plate were examined for bullet penetration. Ammunition was either 0.50 Cal Armor Piercing Incendiary Tracer (APIT) or 0.50 Cal M2 Armor Piercing (AP). Projectile weights were 39.4 grams (gm) for APIT and 44.8-44.9 gm for AP. In most cases, velocities were in the range of 2600-2700 feet/sec.

Example 1

Benchmarking 0.50 Cal APIT

Penetrating power of the projectile was determined by using rolled homogenous armor (RHA) and aluminum T6061 specimen. In the case of three RHA, 6×6 inch and 0.5 inch thick plates were stacked to produce 1.5 inch thick test piece. The panel was shot three times. The depth of penetration was measured. The depth when converted to areal density corresponded to about 50 lbs/ft$^2$. In the case of aluminum, two cylinders of 3.5 inch and 2 inch thick were joined to produce a 4 inch deep sample. From measured depth of penetration, equivalent areal density for comparison was about 46 lbs/ft$^2$.

Armor Test

A cone shaped alumina ceramic tile with a square base having length and width of about 50 mm (cone design CD1) and with a hemi-spherical cavity about 12 mm deep and about 34 mm wide having areal density of 14.14 lbs/ft$^2$ were bonded to a fiberglass composite plate (6×6 inch and 0.5 inch thick, 5.2 lbs/ft$^2$). The sample was mounted in an aluminum picture-frame having an opening of 4×4 inch. The tile was constrained by ¾ inch alumina balls used to fill empty space between the tile and aluminum frame. A witness foil in front of a sample was used to pin-point location of impact on the cone. The location of the hit was 10 mm NW of cone apex. Although the ceramic shattered, there was no penetration into the base plate and very little damage to the fiber-glass base plate. The total areal density of the armor was 19.34 lbs/ft$^2$, a number that is considerably less than 50% the areal density of RHA tested under the same conditions. Examination of the debris showed that the steel core was totally shattered and the shattered pieces left a slightly deeper impression on the backing. By locating the position of the impact and position of the deepest impression, it was clear that the fragments were deflected along the inclined surface of the cone.

Example 2

A ceramic cone shaped alumina tile with a square base (about 50×50 mm) of cone design CD1 having an areal density of 14.6 lb/ft$^2$ was bonded to a High Hard Armor steel plate (HHA) that was 0.15 inch thick. The ceramic tile had a hemi-spherical cavity with maximum depth of about 13.8 mm and width of about 35 mm. The tile was placed in a 6×6 inch aluminum frame with 4×4 inch opening. The extra space between the target tile and aluminum frame was filled with ¾ inch alumina balls. Test projectile was 0.50 Cal APIT. The impact location was recorded by using a witness paper before the impact. The hit location was at the mid-point of the cone where ceramic thickness was close to minimum. The velocity measurements showed values of 2684 and 2669 ft/sec. There was no penetration into steel although it showed localized deformation. The total areal density of the armor sample was 20.7 lbs/ft$^2$, a number distinctly less than 50% of the areal density of RHA needed to defeat the equivalent ballistic threat.

Example 3

Two flat alumina tiles, 15 and 6 mm thick were bonded to 0.15 inch HHA plate and tested using a procedure described in examples 1 and 2 and the projectile was 0.50 Cal APIT. The total areal density was 22.6 lbs/ft$^2$. The armor did not stop the projectile. The velocity was about 2730 feet/sec.

Example 4

A 12×12×2 inch box was constructed out of angled irons as brackets. The front surface was 3/16 inch polycarbonate sheet and the back surface was a combination of a ⅛ inch thick HHA and 0.55 inch thick fiber-glass panel supplied by MFG (MFG-10; E-glass with phenolic resin). The intervening space of about 2 inch was filled with flowable balls of alumina with a nominal diameter of ¾ inch. This panel was hit by 0.50 Cal APIT projectile 3 times. The velocity range was 2580 to 2630 feet/sec. Polycarbonate sheet showed a small puncture at the entrance and the resultant hole was too small for balls to flow out. Effective areal density was about 29.2 lbs/ft$^2$. No penetration was observed. In each case, the cavity generated by the hit became filled by ¾ inch balls thus providing a renewable armor. In such a case, a bed of balls above the area hit by the projectile served as a reservoir for the cavity below. After each hit the total bed height decreased which could be replenished by creating appropriate external reservoir.

Example 5

0.50 Cal M2-AP Projectile & Benchmarking with RHA and aluminum: The procedure described in Example 1 was repeated using a more aggressive (penetrating) projectile. The data for equivalent RHA areal densities were 56-58 lbs/ft$^2$ and for aluminum it was 49 lbs/ft$^2$. For equivalent testing conditions, panels were fabricated with 0.15 inch HHA backing. Alumina ceramic tiles according to cone design 2 with internal hemispherical cavities. Tile with areal densities 17.4-17.9 lbs/ft$^2$ were bonded to HHA backing using a polymeric adhesive. Following conditions described in previous examples and benchmarking tests, panels were shot at a point 9-10 mm off of its apex where the effective thickness was only 18-19 mm. In three out of three shots, no penetration occurred. On the other hand, flat tiles having a thickness of 22.3 mm thick with similar HHA backing failed to stop the projectile. Flat tiles having thickness of about 24.8 mm were needed to defeat the projectile. In all cases, velocities were in the range of 2680-2720 inch/sec. It is clear that the inclined face of a cone with thinner wall can defeat a projectile compared to a flat tile of a thicker wall. While flat tile based panels' areal densities were above 25.62 lbs/ft$^2$, areal densities of cone (CD2) based panels were lower by about 1-1.5 lbs/ft$^2$. In addition, these areal densities were less than the 50% of the areal densities needed for all steel armor.

Example 6

Polyurethane material developed by Team Wendy and described in U.S. Pat. No. 7,078,443, issued to Milliren, has excellent shock absorbing properties. Such a material has been used in the armor architecture described above to bond ceramic to the base material, to encase ceramic and spall layer for multi-hit capability and to reduce impact force.

To measure the shock absorbing properties of a visco-elastic polyurethane layer, an apparatus was designed with four load cells. It contained a stationary plate mounted on a rigid backing and a moveable support that was free to move in the direction of the projectile. Four load cells were placed in such a way that their bases were fastened to the stationary plate while the sensing heads were in intimate contact with the moveable plate. The armor specimen was placed on this moveable support. For the purpose of test, 2 inch thick aluminum cylinder was used as a backing material. For simplicity, ¾ inch alumina balls and ¼ inch alumina flat tiles were used to compare the effect of polyurethane. In experiment A, the packed bed of ¾ inch alumina balls and alumina tile were encased in the polymer in such a way that the ceramic components were in contact with each other. There was no intervening polymer layer. In experiment B, conditions of Experiment A were repeated except all alumina balls were coated with a thin layer of polyurethane elastomer. A fast data acquisition system (Dewtron model DEWE 800) was used to capture transient impact force. The maximum total force from four load cells was used to compare effects of intervening layer of polyurethane layer. In experiment A, The impact peak force was measured to be 27208 lbf. In experiment B, on the other hand, the resultant peak force was 11347 lbf. This experiment showed that a visco-elastic polyurethane layer or its equivalent can be used to reduce the impact force significantly.

The complete disclosure of all documents such as patents, patent applications, and publications cited herein are incorporated by reference. While various embodiments in accordance with the present invention have been shown and described, it is understood the invention is not limited thereto, and is susceptible to numerous changes and modifications as known to those skilled in the art. Therefore, this invention is not limited to the details shown and described herein, and includes all such changes and modifications as encompassed by the scope of the appended claim.

What is claimed is:

1. A composite armor comprising:

a disruptive layer comprising a sheet of adjoining polygonal ceramic tiles encased by a retaining polymer, the ceramic tiles having a non-spherical deflecting front surface for redirecting a projectile, said deflecting front surface having at least one angle of inclination in the range of about 15 to 45 degrees relative to a plane formed by said sheet of adjoining ceramic tiles such that said deflecting front surface forms a point or edge on said deflecting front surface, wherein said deflecting front surface flares upward forming a thicker rim along outer edges of the polygonal ceramic tile; and a backing layer adjacent to the disruptive layer.

2. The composite armor of claim 1, wherein the backing layer comprises polymer encased reinforcement comprising steel wires, metal bonded steel wires, ceramic or glass fibers, or a metallic sheet.

3. The composite armor of claim 1, further comprising a spalling layer adjacent to the disruptive layer, wherein the spalling layer comprises a polymer-encased reinforcement.

4. The composite armor of claim 1, wherein the disruptive layer has an areal density less than 25 lbs/ft$^2$.

5. The composite armor of claim 1, wherein the retaining polymer comprises a polyurethane polymer.

6. The composite armor of claim 1, wherein the retaining polymer comprises fire retarding particles.

7. The composite armor of claim 6, wherein the fire-retarding particles have a diameter of about 0.1 mm to about 3 mm.

8. The composite armor of claim 6, wherein the fire-retarding particles comprise a material selected from the group consisting of perlite, vermiculite, zinc borate, alumina hydrate, aluminum phosphate, aluminum borates and mixtures thereof.

9. The composite armor of claim 1, wherein the ceramic tiles comprise one or more ceramics selected from the group consisting of aluminum oxide, magnesium oxide, silicon carbide, silicon nitride, silicon oxide, boron carbide, borides, carbides or nitrides of aluminum, silicon, or refractory metals.

10. The composite armor of claim 1, wherein a portion of the deflecting front surface of the ceramic tiles is substantially conical or pyramidal.

11. The composite armor of claim 10, wherein the deflecting front surface of the ceramic tiles comprises an angle of inclination of about 20 to about 30 degrees.

12. The composite armor of claim 10, wherein the adjoining polygonal ceramic tiles further comprise a base portion opposite from the deflecting front surface, and wherein the base portion includes a cavity.

13. The composite armor of claim 12, wherein said cavity includes a fire retarding material.

14. The composite armor of claim 1, wherein the deflecting front surface of the ceramic tiles comprises two faces each having an angle of inclination in the range of about 15 to 45 degrees, wherein said two faces intersect to form a ridge along said deflecting front surface.

15. The composite armor of claim 1, further comprising a trough region between the thicker rim and a central conical or pyramidal portion.

16. The composite armor of claim 15, said trough region comprising alternating ridges or hills.

17. The composite armor of claim 1, wherein an adhesive layer is provided between the backing layer and the disruptive layer.

18. The composite armor of claim 1, wherein the composite armor has an areal density of about 25 pounds per square foot or less.

19. The composite armor of claim 1, said point or ridge being rounded.

20. A composite armor comprising:

a disruptive layer comprising a sheet of adjoining polygonal ceramic tiles encased by a retaining polymer including fire-retarding particles, the ceramic tiles having a non-spherical deflecting front surface for redirecting a projectile, said deflecting front surface having at least one angle of inclination in the range of about 15 to 45 degrees relative to a plane formed by said sheet of adjoining ceramic tiles such that said deflecting front surface forms a point or edge on said deflecting front surface, wherein said deflecting front surface flares upward forming a thicker rim along outer edges of the polygonal ceramic tile; and a backing layer bonded to the disruptive layer comprising a sheet of metal or polymer-encased reinforcement, wherein the composite armor has an areal density of less than 25 lbs/ft$^2$.

21. The composite armor of claim 20, said point or ridge being rounded.

* * * * *

UNITED STATES PATENT AND TRADEMARK OFFICE

CERTIFICATE OF CORRECTION

PATENT NO. : 7,866,248 B2
APPLICATION NO. : 11/656603
DATED : January 11, 2011
INVENTOR(S) : Dan T. Moore, III et al.

It is certified that error appears in the above-identified patent and that said Letters Patent is hereby corrected as shown below:

At Col. 8, Line 25, insert --1/2-- before the word "inch".

Signed and Sealed this
Twelfth Day of April, 2011

David J. Kappos

David J. Kappos
*Director of the United States Patent and Trademark Office*